US005480247A

United States Patent [19]

Saikawa et al.

[11] Patent Number: 5,480,247

[45] Date of Patent: Jan. 2, 1996

[54] SHEET SUPPLYING APPARATUS

[75] Inventors: Satoshi Saikawa, Inagi; Tetsuo Suzuki, Yokohama; Soichi Hiramatsu, Yokohama; Masahiro Taniguro, Yokohama; Hiroyuki Saito, Yokohama; Haruyuki Yanagi, Yokohama; Takashi Nojima, Tokyo; Hiroyuki Kinoshita, Kawasaki; Hideaki Kawakami, Yokohama, all of Japan

[73] Assignee: Canon Kabushiki Kaisha, Tokyo, Japan

[21] Appl. No.: 402,980

[22] Filed: Mar. 13, 1995

Related U.S. Application Data

[63] Continuation of Ser. No. 66,378, May 25, 1993, abandoned.

[30] Foreign Application Priority Data

| | | | |
|---|---|---|---|
| May 29, 1992 | [JP] | Japan | 4-164292 |
| May 29, 1992 | [JP] | Japan | 4-164295 |
| Jul. 31, 1992 | [JP] | Japan | 4-225149 |

[51] Int. Cl.[6] ..... B41J 13/00

[52] U.S. Cl. ..... 400/629; 400/624; 271/119; 271/126; 271/170

[58] Field of Search ..... 408/624, 629, 408/625; 271/10, 16, 17, 109, 119, 121, 126, 127, 145, 167, 169, 170, 110, 111, 117, 118

[56] References Cited

U.S. PATENT DOCUMENTS

| | | | |
|---|---|---|---|
| 3,348,838 | 10/1967 | Springer | 271/170 X |
| 4,372,547 | 2/1983 | Yanagawa et al. | 271/10 |
| 4,650,175 | 3/1987 | Wexler | 271/170 X |
| 5,145,164 | 9/1992 | Kan | 271/170 X |
| 5,168,291 | 12/1992 | Hiramatsu et al. | 346/140 R |

FOREIGN PATENT DOCUMENTS

| | | | |
|---|---|---|---|
| 202228 | 11/1983 | Japan | 271/167 |
| 276737 | 11/1990 | Japan | 271/170 |
| 162331 | 7/1991 | Japan | 271/119 |
| 243542 | 10/1991 | Japan | 271/119 |
| 94339 | 3/1992 | Japan | 271/119 |
| 148739 | 5/1992 | Japan | 271/170 |

OTHER PUBLICATIONS

IBM Technical Disclosure Bulletin, vol. 24, No. 10, Mar. 1982 "Paper Feed System"; L. Adams, Jr.

IBM Technical Disclosure Bulletin, vol. 20, No. 4, Sep. 1977 "Automatic Document Feed Gate"; J. D. Froula et al.

*Primary Examiner*—Chris A. Bennett

*Attorney, Agent, or Firm*—Fitzpatrick, Cella, Harper & Scinto

[57] ABSTRACT

A sheet supplying apparatus comprises a sheet supporting plate for supporting sheets, a separation claw for regulating one end of a leading edge of the sheets supported by the sheet supporting plate, sheet supply rollers for feeding out the sheets supported by the sheet supporting plate, a regulator for regulating leading ends of the sheets supported by the sheet supporting plate, and a guide for guiding side edges of the sheets on which the separation rollers act. One sheet supply roller is positioned between the separation claw and the regulator in a direction perpendicular to a sheet feeding direction.

30 Claims, 28 Drawing Sheets

SHEET SUPPLYING APPARATUS

This application is a continuation of application Ser. No. 08/066,378 filed May 25, 1993, now abandoned.

BACKGROUND OF THE INVENTION

1. Field of the Invention

The present invention relates to a sheet supplying apparatus for automatically supplying sheets one by one.

2. Related Background Art

In recording apparatuses such as printers, copying machines, facsimile machines and the like, an image of a dot pattern is recorded on a recording sheet such as a paper sheet, a plastic film and the like by selectively energizing energy generating elements of a recording head in response to inputted image information. Such recording apparatuses can be grouped into an ink jet type, a wire dot type, a thermal type, an electrophotographic type and the like in accordance with the recording fashion. Further, the recording sheet used with the recording apparatus may be a thick sheet such as a post card, an envelope or the like, or a special sheet such as a plastic film, as well as a normal sheet. The recording sheets can be supplied one by one by a manual insertion or can be supplied automatically and continuously by an automatic sheet supplying apparatus.

FIG. 52 is a perspective view showing an example of a conventional sheet supplying apparatus. As shown in FIG. 52, such sheet supplying apparatus generally has a sheet supply drive portion comprising left (L) and right (R) sheet supply rollers 1101, 1102, a sheet supply roller shaft 1106, a drive gear 1107 and the like, and a sheet supply cassette portion comprising left (L) and right (R) side guides 1103, 1104, a pressure plate 1105 and the like and on which sheets are loaded. A driving force from a recording sheet feeding apparatus of the recording apparatus is transmitted to the drive gear 1107 to rotate the sheet supply rollers 1101, 1102, thereby separating sheets one by one via the left (L) and right (R) separation claws 1109, 1110 and supplying a separated sheet P.

However, in this conventional sheet supplying apparatus, since the pair of left and right sheet supply rollers 1101, 1102 and the pair of left and right separation claws (separation means) 1109, 1110 are provided, the following disadvantages occur.

(1) The apparatus is made complicated and expensive because of numerous of parts.

(2) The apparatus is made large-sized since a space through which the sheet supply roller shaft 1106 passes is required.

To eliminate such disadvantages, as disclosed in U.S. Pat. No. 4,372,547, a technique wherein a separation claw and a sheet supply roller are arranged at only one side (left or right) of the apparatus has been proposed. However, when the separation claw and the sheet supply roller are arranged at only one side of the apparatus, the sheet is skew-fed during the separation thereof. Therefore, in the above U.S. Pat. No. 4,372,547, a special roller for preventing the skew-feed of the sheet is added, which makes the reduction of cost difficult.

SUMMARY OF THE INVENTION

An object of the present invention is to simplify the whole construction of a sheet supplying apparatus by providing a separation means only at one side of the apparatus.

Another object of the present invention is to prevent the skew-feed of a sheet which would be caused when a sheet supplying apparatus is simplified by providing a separation means only at one side thereof, with a simple construction.

To achieve these objects, the present invention provides a sheet supplying apparatus comprising a sheet supporting means for supporting sheets, a separation means for regulating one of front corners of the sheets supported by the sheet supporting means, a sheet supply means for feeding out the sheets supported by the sheet supporting means, a regulating means for regulating leading ends of the sheet supported by the sheet supporting means, and a guide means for guiding side edges of the sheets on which the separation means acts. The sheet supplying apparatus is arranged between the separation means and the regulating means with respect to a direction perpendicular to a sheet feeding direction.

With this arrangement, the leading end of the sheet fed out by the sheet supply means is regulated by the regulating means so that the sheet is subjected to a force directing toward a direction opposite to the sheet feeding direction. As a result, the sheet is turned or rotated so that the sheet is abutted against the guide means for guiding the side edge of the sheet on which the separation means acts. Thus, since the sheet is moved while being abutted against the guide means, the sheet is fed without skew-feed.

Therefore, it is possible to provide a sheet supplying means which has a simplified construction and which can feed the sheet stably.

DETAILED DESCRIPTION OF THE PREFERRED EMBODIMENTS

An embodiment of the present invention is shown in FIGS. 1 to 12. This embodiment relates to an automatic sheet supplying apparatus incorporated into a printer which comprises a sheet supply portion, a sheet feed portion, a sheet discharge portion, a carriage portion, and a cleaning portion. First of all, these portions will be briefly explained.

Figure 1:
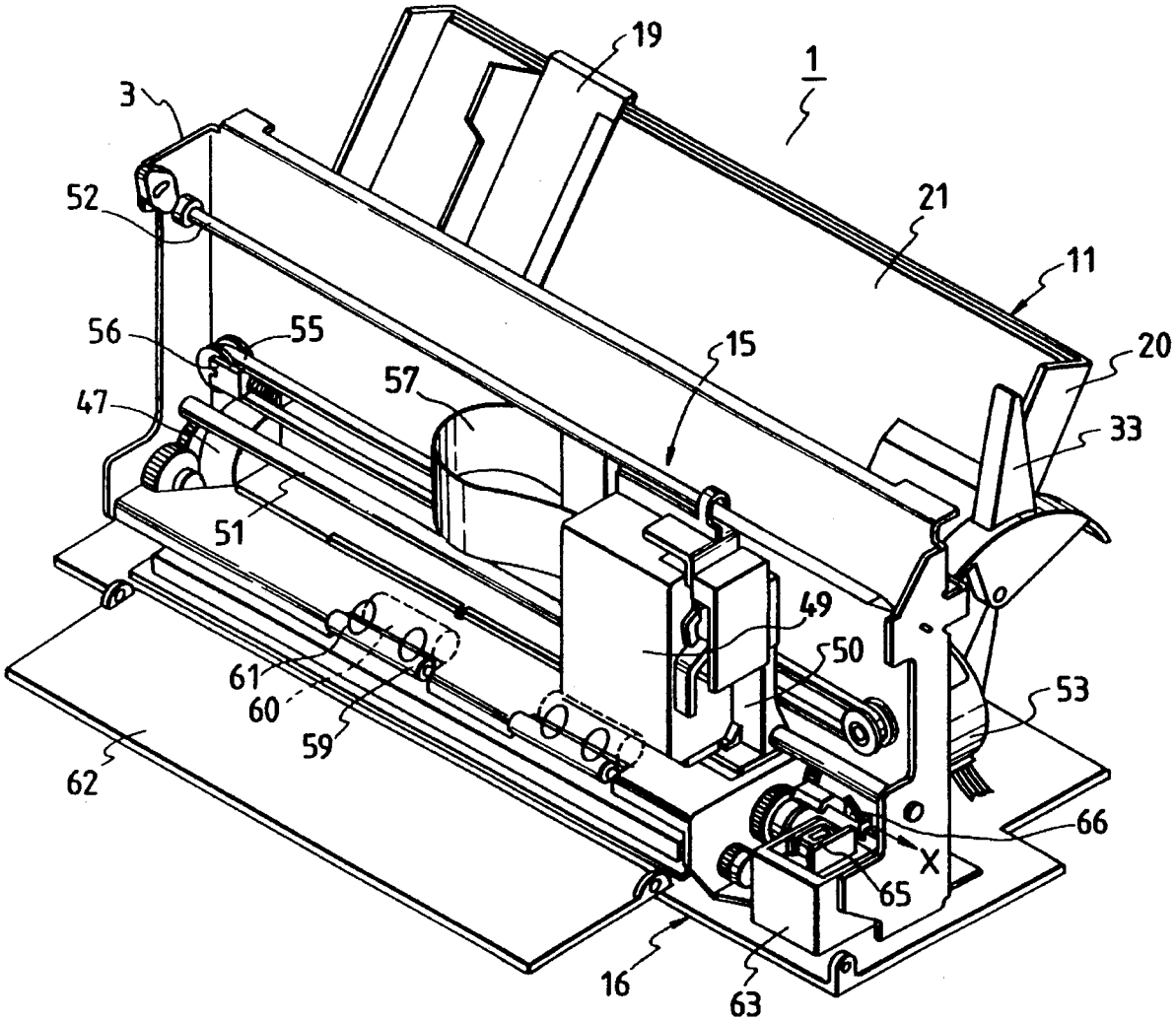
FIG. 1 is a perspective view of a printer incorporating a sheet supplying apparatus to which the present invention is applied.
Figure 2:
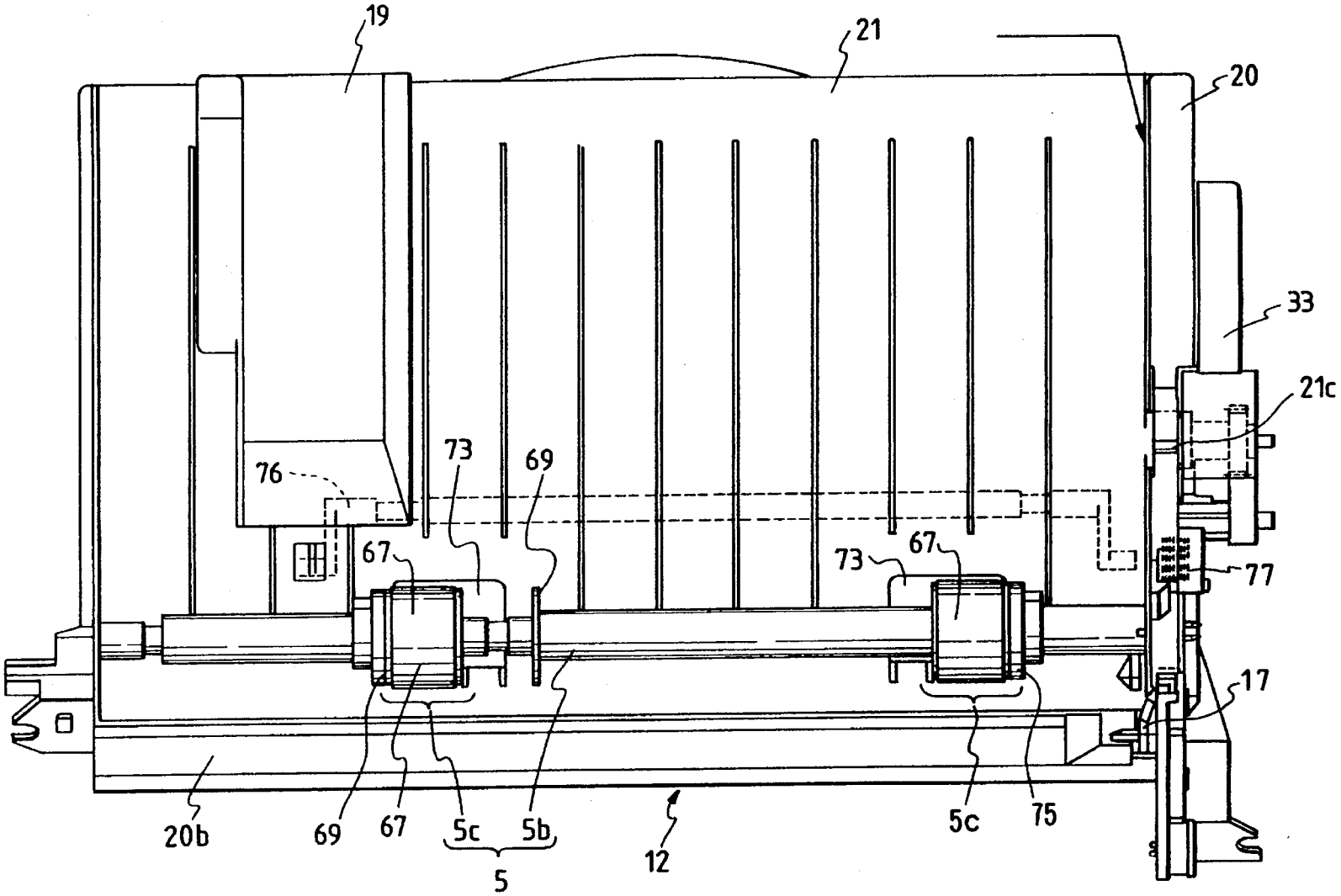
FIG. 2 is a front view of the sheet supplying apparatus of FIG. 1.
Figure 4:
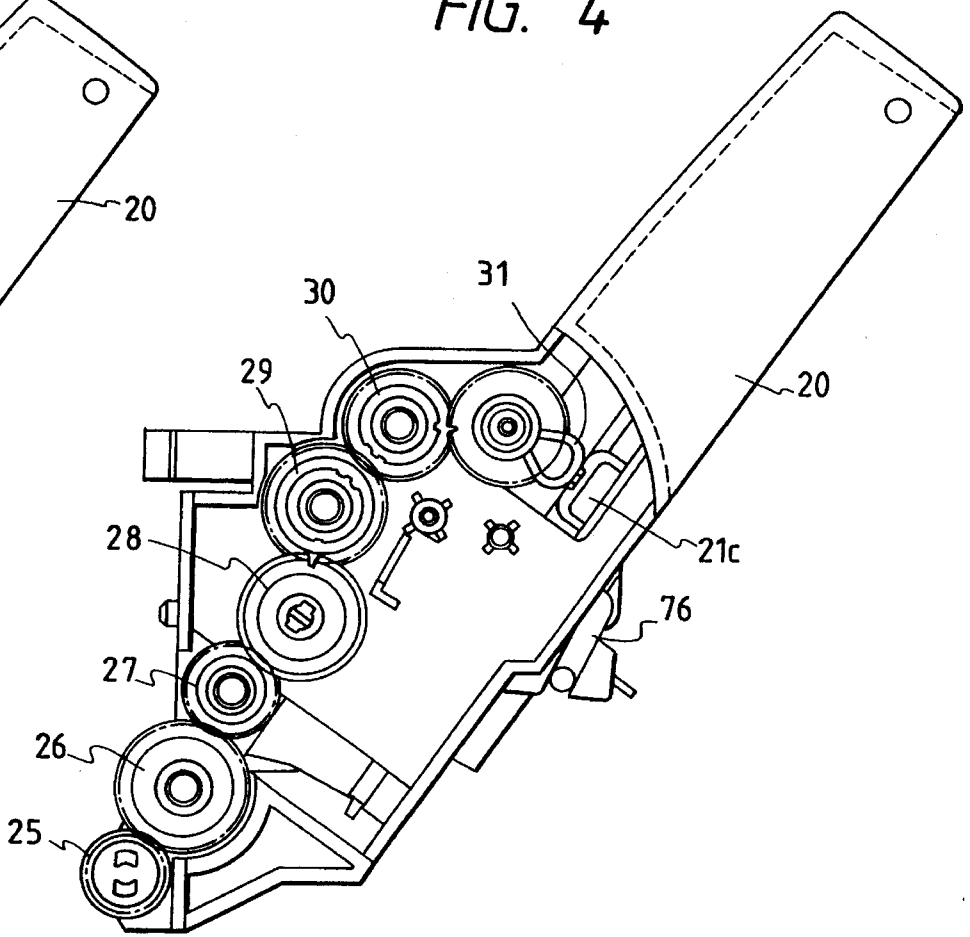
FIG. 4 is a view showing a condition that a pressure plate is pushed down in the sheet supplying apparatus of FIG. 1.
Figure 3:
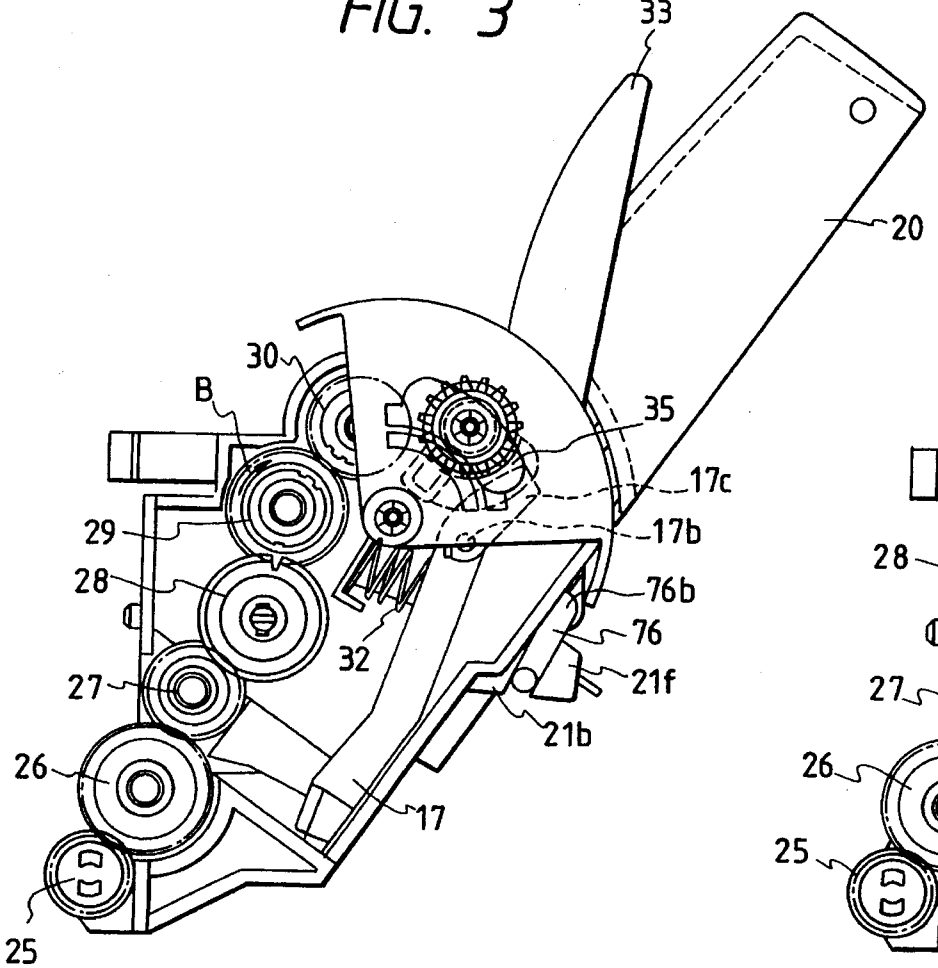
FIG. 3 is a view showing a gear train of a drive system of the sheet supplying apparatus of FIG. 1.
Figure 6:
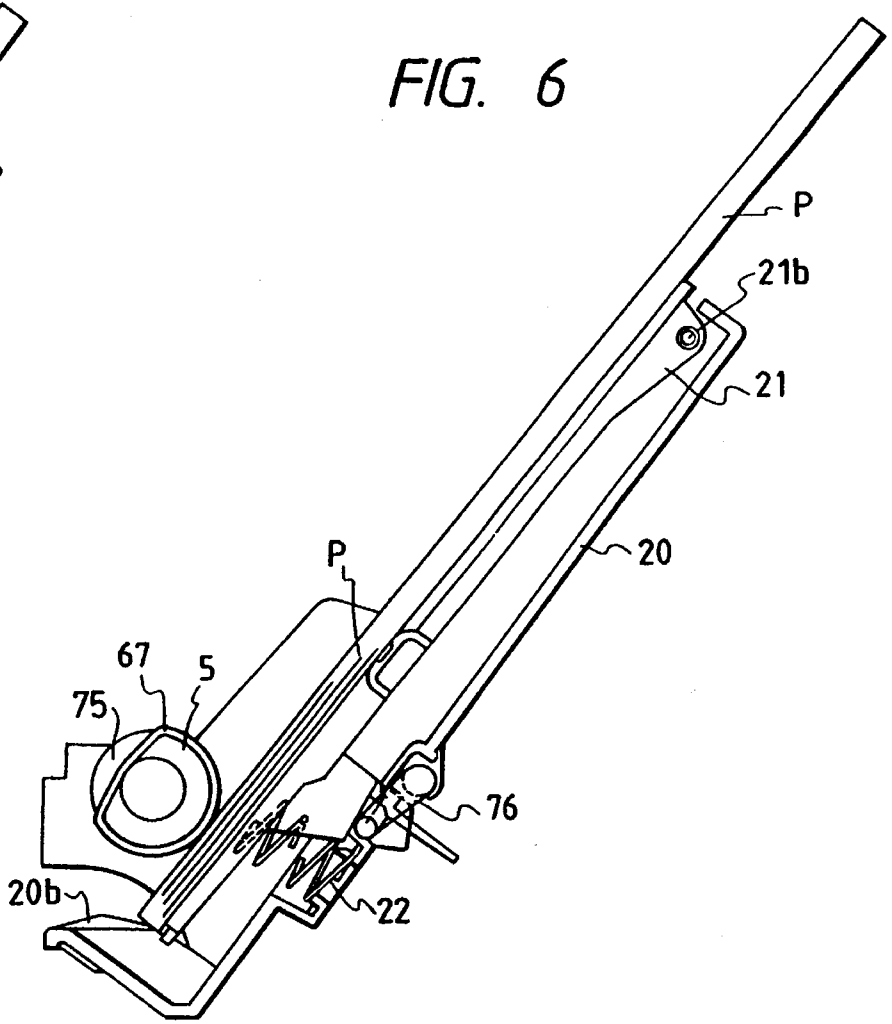
FIG. 6 is a longitudinal sectional view of the sheet supplying apparatus of FIG. 1 in an operative condition.

FIG. 1 is a perspective view of the whole printer, FIG. 2 is a front view of the sheet supply portion, and FIG. 3 is a side view of the sheet supply portion.

The sheet supply portion 11 is attached to the printer with an angle of 30–60 degrees, and sheets P set in the sheet supply portion are discharged in a horizontal direction after they are printed. The sheet supply portion 11 comprises a sheet supply roller 5, a separating pawl or claw 17, a movable side guide 19, a base 20, a pressure plate 21, pressure plate springs 22 for biasing the pressure plate 21 upwardly, drive gears 25 to 30, a release cam 31 for pushing down the pressure plate 21, a claw spring 32 for biasing the separating claw 17 upwardly, a releasing lever 33 and a releasing cam 35. In an inoperative condition, since the pressure plate 21 is pushed down by the release cam 31 to a position shown in FIG. 5, the sheets P set on the pressure plate 21 are spaced apart from the sheet supply roller 5.

In a condition that the sheets P are set, a driving force from a feed roller 36 is transmitted to the sheet supply roller 5 and the release cam 31 via the drive gears 25 to 30. When the release cam 31 is separated from the pressure plate 21, the pressure plate 21 is lifted up to a position shown in FIG. 6 so that the sheet stack P is urged against the sheet supply roller 5. As a result, when the sheet supply roller 5 is rotated, the sheets P are picked up by the sheet supply roller and are separated one by one by the separating claw 17. The separated sheet P is fed to the sheet feed portion. The sheet supply roller 5 and the release cam 31 are rotated by one revolution until the sheet P is fed into the sheet feed portion 12, and then are stopped in an initial condition that the sheet stack P is spaced apart from the sheet supply roller 5.

Figure 7:
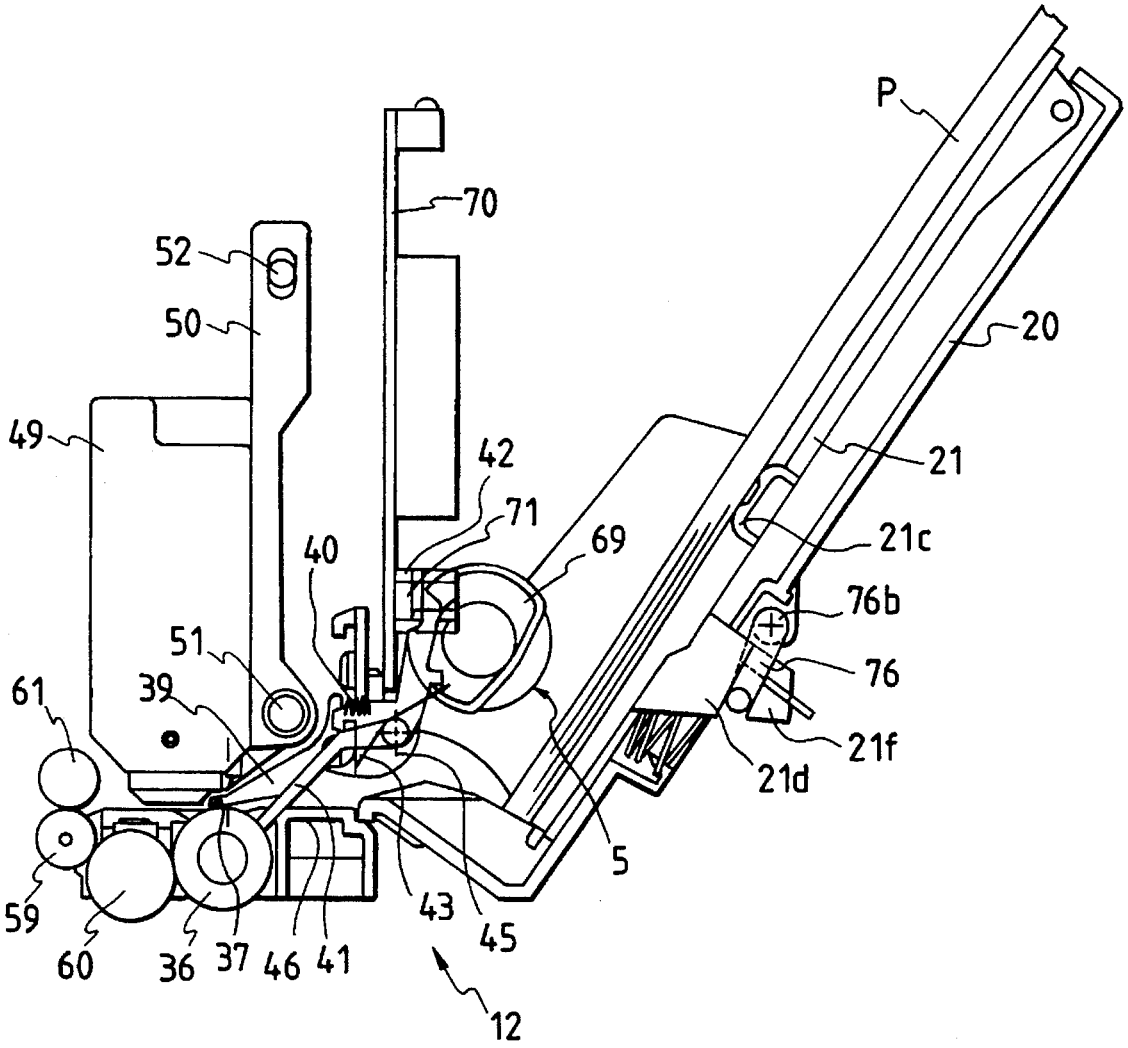
FIG. 7 is a longitudinal sectional view of the printer of FIG. 1.

As shown in FIG. 7, the sheet feed portion 12 comprises the feed roller 36, a pinch roller 37, a pinch roller guide 39, a pinch roller spring 40, a PE sensor lever 41, a PE sensor 42, a PE sensor spring 43, an upper guide 45, and a platen 46. The sheet P fed in the sheet feed portion 12 is fed to a nip between the feed roller 36 and the pinch roller 37 through the platen 46, pinch roller guide 39 and upper guide 45. The PE sensor 41 is disposed in front of the nip between the feed roller 36 and the pinch roller 37 and serves to detect a leading end of the sheet P to determine a printing position on the sheet P. The pinch roller 37 is urged against the feed roller 36 by biasing the pinch roller guide 39 by the pinch roller spring 40, thereby providing a feeding force for the sheet P. The sheet P fed by the paired rollers 35, 37 is moved along the platen 46 by the rotation of the paired rollers 36, 37 given by an LE motor 47 (FIG. 1); meanwhile, an image is printed on the sheet P by a recording head 49 in response to predetermined image information. The recording head 49 is formed integrally with an ink tank to constitute an exchangeable ink jet recording head. The recording head 49 is provided with electrothermal converters so that ink can be discharged from discharge opening or openings or the recording head by utilizing the pressure change due to growth and contraction of bubble(s) caused by the film boiling generated by thermal energy produced by selectively energizing the converters, thereby effecting the recording.

As shown in FIG. 1, the carriage portion 15 comprises a carriage 50 on which the recording head 49 is mounted, a guide shaft 51 along which the carriage 50 can be reciprocally shifted in a direction perpendicular to a sheet feeding direction, a guide 52 for holding a rear end of the carriage 50 and for maintaining a gap between the carriage and the sheet, a timing belt 55 for transmitting a driving force from a carriage motor 53 to the carriage 50, idle pulleys 56 for mounting the timing belt 55 thereon and for tensioning the timing belt, and a flexible cable 57 for transmitting a head drive signal from an electric substrate to the recording head 49. By scanning the recording head 49 and the carriage 50 together, the image is formed on the sheet P on the platen 46.

The sheet discharge portion comprises a sheet discharge roller 59, a transmission roller 60 for transmitting the driving force from the feed roller 36 to the sheet discharge roller 59, spurs 61 for aiding the discharge of the sheet, and a sheet discharge tray 62. The sheet is discharged onto the sheet discharge tray 62 by the sheet discharge roller 59 and spurs 61 without the deterioration of the image printed on the sheet P.

The cleaning portion 16 comprises a pump 63 for cleaning the recording head 49, a cap 65 for suppressing the drying of the recording head 49, and a drive switching arm 66 for switching the driving force from the feed roller 36 between the sheet supply portion 11 and the pump 63. Other than the sheet supplying operation and the cleaning operation, the switching arm 66 is positioned in a position shown in FIG. 1. In this position, since a planetary gear (not shown) which can be rotated around a rotation axis of the feed roller 36 is fixed at a predetermined position, the driving force of the feed roller 36 is not transmitted to the pump 63 and the sheet supply portion 11. When the drive switching arm 66 is shifted in a direction shown by the arrow X in response to the shifting movement of the carriage 50, and the planetary gear is moved in response to the normal rotation and the reverse rotation of the feed roller 36. That is to say, when the feed roller 36 is rotated normally, the driving force is transmitted to the sheet supply portion; whereas, when the feed roller is rotated reversely, the driving force is transmitted to the pump 63.

Further, the LF motor 47 for driving the feed roller 36 and the like and the carriage motor 53 for driving the carriage 50 comprise stepping motors each of which is rotated by a predetermined angle in response to a signal sent from a corresponding driver.

A sensor plate 69 is attached to sheet supply roller portion 5*c* of one (leftmost) sheet supply roller 5, which sensor plate has a radius smaller than that of a sheet supply roller rubber 67 mounted around the sheet supply roller portion. The sensor plate 69 has a notch so that a roller sensor (photo-interrupter) 71 directly mounted on an electric substrate 70 (FIG. 7) is not blocked only when the sheet supply roller 5 and the release cam 31 are in the initial position shown in FIG. 5. By detecting the condition of the sensor plate 69, it is possible to detect the angular position of the sheet supply roller 5 and the angular position of the release cam 31 in phase with the sheet supply roller 5, thereby obtaining the control timing in the sheet supplying sequence.

Next, main elements of the sheet supply portion 11 will be fully explained.

Figure 5:
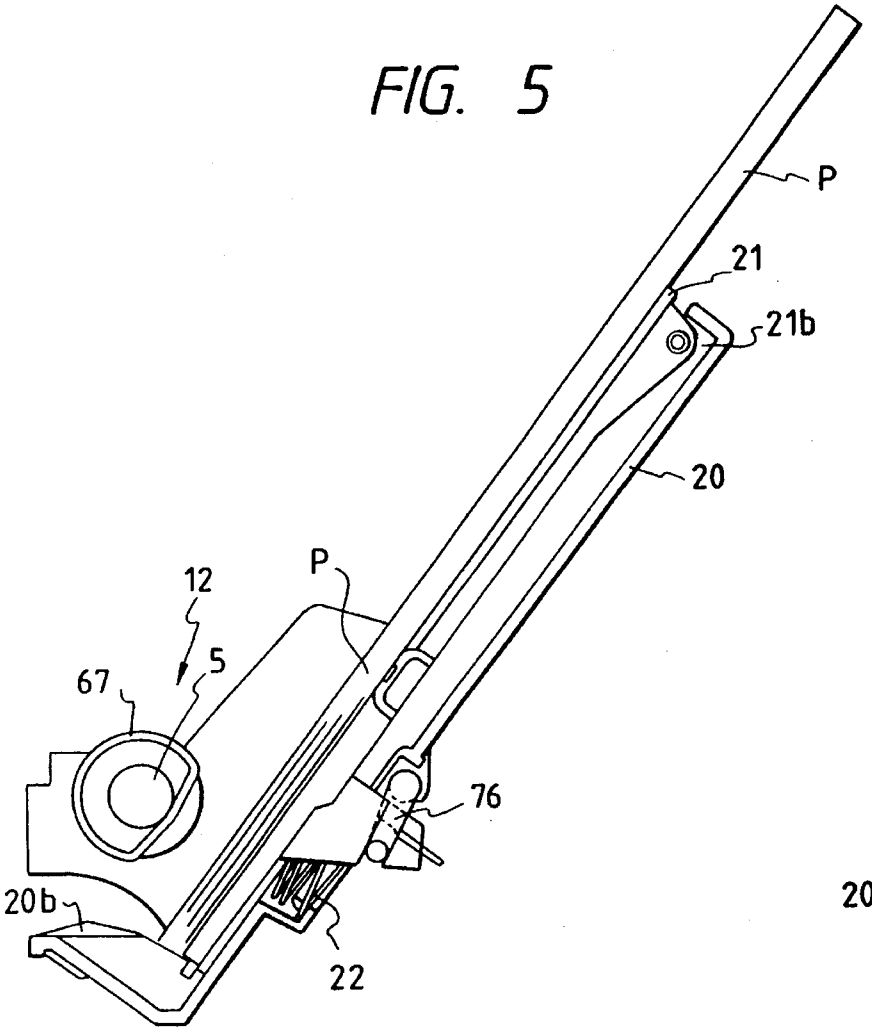
FIG. 5 is a longitudinal sectional view of the sheet supplying apparatus of FIG. 1 in an inoperative condition.

The sheet supply portion 11 is constituted as a unit wherein various elements are attached to the base 20. In the illustrated embodiment, the sheet supply portion 11 is of a so-called one side reference type wherein one side of the sheet is used as a reference, and, in the illustrated embodiment, an inner surface of a right side plate (side wall) of the base (FIG. 2) is utilized as a sheet reference. The base 20 is provided with a recess into which the pressure plate 21 is retarded as shown in FIG. 5 and within which the pressure plate springs 22 are arranged in a confronting relation to the roller portions 5*c* of the sheet supply roller 5. The pressure plate 21 is pivotally connected to the base 20 at its upper end via a pressure plate shaft 21*b* for pivotal movement around the pressure plate shaft 21*b*. Separation pads 73 made of material having relatively great coefficient of friction (such as artificial leather) are secured to the surface of the pressure plate 21 in a confronting relation to the roller portions 5*c* of the sheet supply roller 5, thereby preventing the double feed of the sheets when number of the sheets becomes few. Further, the movable side guide 19 can be slid on the pressure plate 21 to the left and right and serves to set the sheets P having different size with respect to the sheet reference.

The sheet supply roller shaft of the sheet supply roller 5 is rotatably supported by the base at its both ends. The sheet supply roller 5 is formed as unitary molded plastic material including a shaft portion 5*b* and the roller portions 5*c*, and the sheet supply roller rubbers 67 for aiding the feeding of the sheet are mounted around the roller portions 5*c*. The roller portion 5*c* has a D-shaped (or semicircular) cross-section, and, a small roller 75 having a radius smaller than that of the sheet supply roller rubber 67 by 0.5 to 3 mm is arranged outwardly of each roller portion 5*c* so that the sheet does not contact with the sheet supply roller rubbers 67 of the sheet supply roller other than the sheet supplying operation, thereby preventing the deterioration of the image on the sheet and preventing the sheet supply roller 5 from being out of position.

Further, two sheet supply roller portions 5*c* are provided and are secured at positions spaced apart from the sheet reference (right side wall of the base in FIG. 2) by about 40 mm and 170 mm, respectively. Accordingly, a sheet of A4 size and the like is fed by two roller portions 5*c*, and a post card and the like is fed by only one roller portion 5*c* near the sheet reference.

Figure 12:
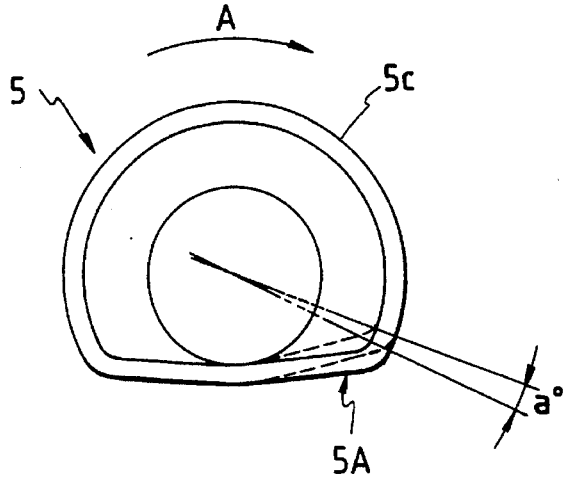
FIG. 12 is a side view of a sheet supply roller of the sheet supplying apparatus of FIG. 1.

Further, the roller portion 5*c* near the separating claw 17 has a cross-section as shown in FIG. 12. The roller portion 5*c* near the separating claw 17 is out of phase regarding the roller portion 5*c* remote from the separating claw 17 so that the former can be abutted against the sheet prior to the latter by an angle of a° in a sheet feeding direction A (FIG. 12). In the sheet supplying and separating operation, although a loop is formed in the sheet P at the position of the separating claw 17 due to the resistance of the separating claw, with the above arrangement, since a portion of the sheet P near the separating claw 17 is firstly moved (before the other portion of the sheet is moved), the delay of the movement of the sheet due to the resistance of the separating claw is cancelled, thereby separating and supplying the sheet P without the skew-feed. Incidentally, a value of the above-mentioned angle a° depends upon the diameter of the roller portion, and, in the illustrated embodiment, the angle is preferably 0.5 to 5° regarding the roller portion having an outer diameter of 24 mm.

When the drive switching arm 66 of the cleaning portion 16 is shifted in the direction X by the shifting movement of the carriage 50 to rotate the feed roller 36 normally, the planetary gear (not shown) is shifted to engage by the input gear 25, thereby transmitting the driving force to the sheet supply portion. The input gear 25 transmits the driving force to the sheet supply roller gear 28 via idler gears 26, 27, thereby rotating the sheet supply roller 5 to supply the sheet P. Further, the sheet supply roller gear 28 transmits the driving force to the release cam 31 via clutch gear 29 and idler gear 30. In this case, the sheet supply roller 5 is in phase with the release cam 31 after one revolution, and, in the initial condition (FIGS. 4 and 5) that the pressure plate 21 is released, the D-cut portion of the sheet supply roller 5 is positioned in a confronting relation to the pressure plate 21 as shown in FIG. 5. The release cam 31 is so shaped that it releases the pressure plate 21 only through an angle of about 120° corresponding to the D-cut portion of the sheet supply roller 5, and, when the other portion (other than the D-cut portion) of the sheet supply roller 5 is contacted with the sheet stack P or the pressure plate 21, it is always contacted with a pressure of 200 to 500 grams.

Further, the release cam 31 pushes down a push-down portion 21*c* of the pressure plate 21 protruded outwardly through a hole formed in the right side plate of the base 20, thereby releasing the pressure plate 21. In this case, a pressure plate cain 76 attached to the base 20 is pushed down by a cam 21*d* of the pressure plate 21 near the push-down portion 21*c*, thereby rotating the pressure plate cam 76 around a pivot 76*b*. As a result, a cam 5*f* arranged outwardly of the left roller portion 5*c* is lowered by the pressure plate cam 76. In this way, even when the push-down portion 21*c* at the end of the pressure plate 21 is pushed down, the pressure plate 21 is not inclined with respect to the base 20, thereby releasing the pressure plate in parallel with the base. A clutch spring 77 is disposed within the clutch gear 29 so that the clutch spring is tightened when the gear 29 is rotated in a direction shown by the arrow B in FIG. 3, thereby preventing the reverse rotation of the clutch gear. Thus, when the registration operation is effected, since the sheet supply roller 5 is not rotated by the elasticity of the sheet P, the good registration can be achieved.

The separating claw 17 can be rotated around a pivot 17*b* and is biased by the claw spring 32 to abut against the sheet stack P or the pressure plate 21 with a pressure of 20 to 100 grams. The separating claw 17 serves to separate so-called normal sheets (plain sheets), and is arranged near the sheet reference as shown in FIG. 2 (only one separating claw is provided), and has a triangular top portion for holding down the front corner of the sheet stack P. Since the sheets P are resisted by the triangular top portion of the separating claw, they can be separated one by one. Further, regarding the separation of thick sheets and the like other than the normal sheets, the sheets are not hooked by the separating claw 17 but are abutted against a lower guide portion 20*b* of the base 20, thereby separating the thick sheets one by one by utilizing the resistance of the lower guide portion 20*b*.

The release lever 33 and the releasing cam 35 are provided on the same shaft. The release lever 33 and the releasing cam 35 are not synchronous with the release cam 31 but are operated independently from the release cam, and are used by an operator to set the sheets P. The release lever 33 and the releasing cam 35 are connected to each other via gears. The release lever 33 can be shifted between three positions, i.e., (1) a feed position, (2) a thick sheet set position and (3) a normal sheet set position, which three positions are angularly spaced apart from each other by an angle of about 20 to 50°. The gear ratio between the release lever and the releasing cam is so selected that the releasing cam 35 is rotated by about 90°, respectively, in correspondence to these three positions of the release Lever 33.

(1) In the feed position, the releasing cam 35 does not act on the push-down portion 21*c* of the pressure plate 21 and a push-down portion 17*c* of the separating claw 17. In the sheet supplying operation, the release lever is in this position.

(2) In the thick sheet set position, since the releasing cain 35 pushed down only the push-down portion 21*c* of the pressure plate 21, the separating claw 17 is lowered along the pressure plate 21, with the result that the thick sheets can be set in a condition that the thick sheets are not hooked by the separating claw 17, (3) In the normal sheet set position, since the releasing cam 35 pushes down both the push-down portion 21*c* of the pressure plate 21 and the push-down portion 17*c* of the separating claw 17, the separating claw 17 is lifted with respect to the pressure plate 21, with the result that the normal sheets can be set in a condition that the normal sheets are hooked by the separating claw 17.

Incidentally, the above-mentioned gears, separating claw 17, release lever 33, releasing cam 35 and the like are provided on a shaft supported by the right side plate of the base 20 so that they can be rotated around this shaft.

Next, the function and control of the sheet supply portion 11 during the sheet supplying operation will be fully explained.

Figure 9A:
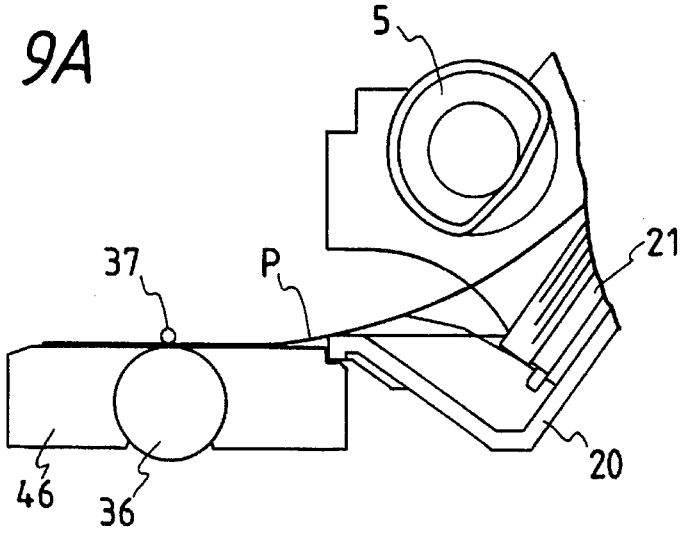
Figure 9B:
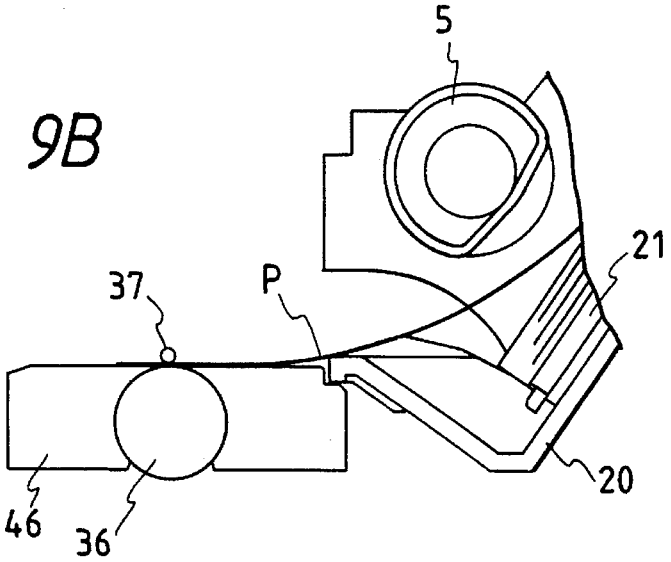
Figure 9C:
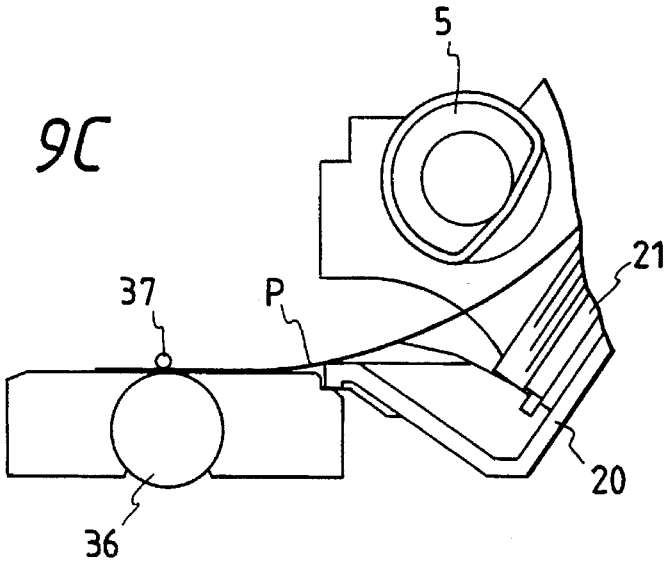
Figure 10:
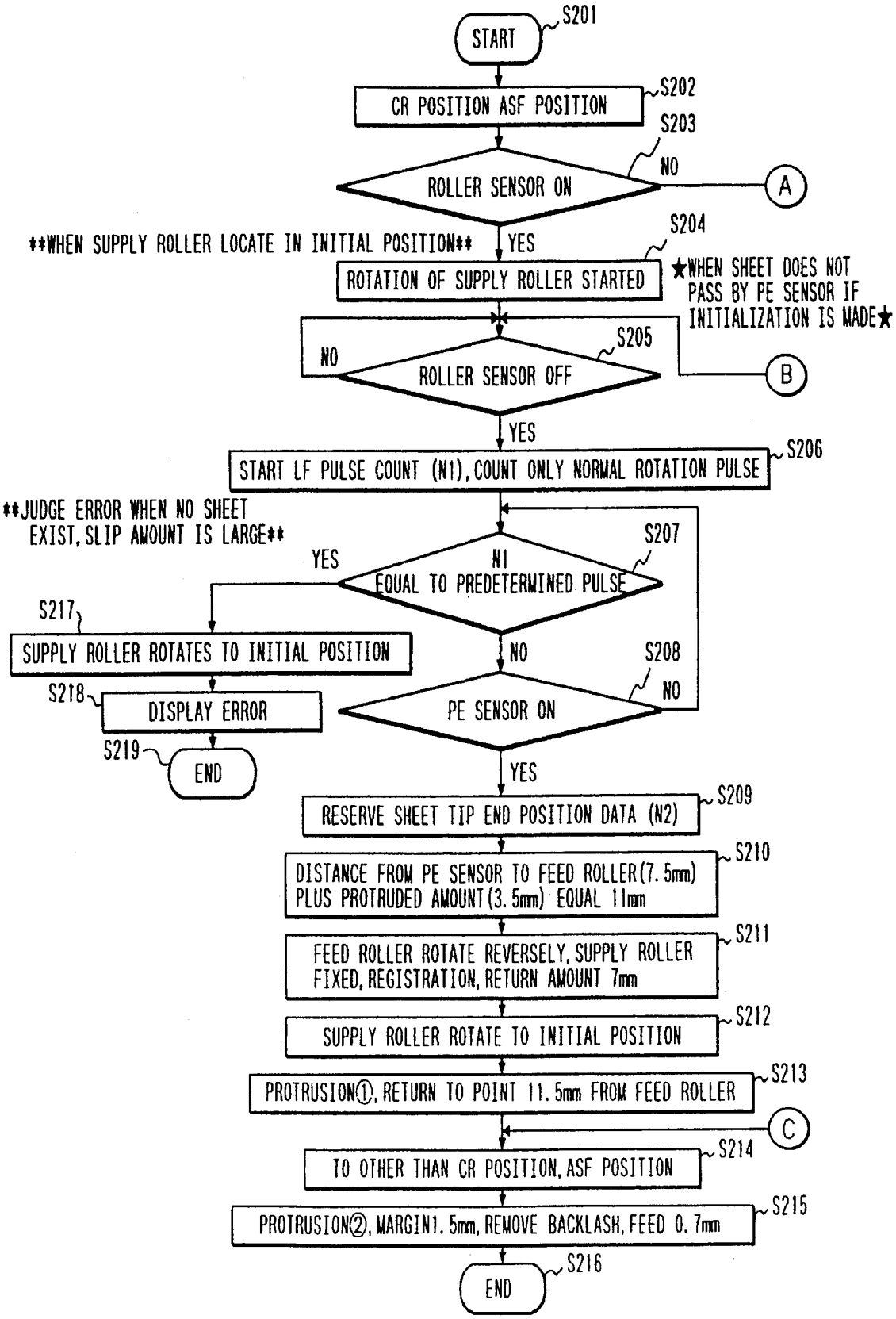
FIGS. 10 and 11 are flow charts showing the sheet supplying operation of the sheet supplying apparatus of FIG. 1.
Figure 11:
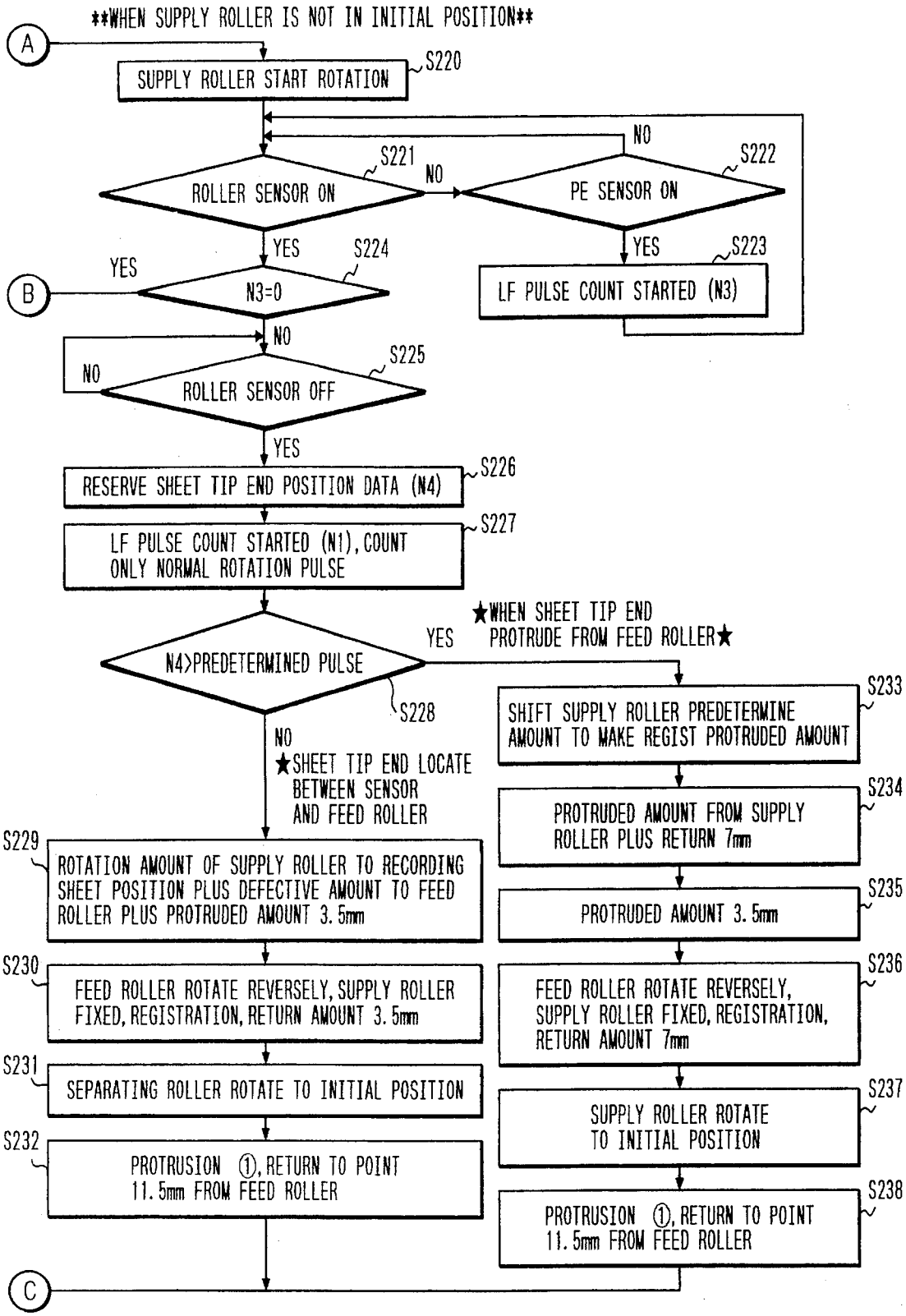

FIGS. 10 and 11 show flow charts for the whole control, and FIGS. 8 and 9 show the sheet supplying operation. As shown in FIGS. 8 to 11, the control can be divided into two cases, i.e., the case where the sheet supply roller 5 is in the predetermined initial position and the case where the sheet supply roller is not in the predetermined initial position (trouble case). First of all, the control when the sheet supply roller 5 is in the predetermined initial position will be explained.

In FIG. 10, in a step S201 a sheet supply start signal is given. Then, in a step S202, the carriage 50 is shifted and the drive switching arm 66 is shifted, so that the driving force from the feed roller 36 can be transmitted to the sheet supply portion (ASF position). Then, in a step S203, the condition of the roller sensor 71 is judged. If the sheet supply roller 5 is in the initial position, the program goes to a step S204; whereas, if not, the program goes to a step S220. When the sheet supply roller 5 is in the initial position, in the step S204, the sheet supply roller 5 is rotated, and, in a step S205, an edge of the sensor plate 69 is detected. In this way, by counting (N1) drive pulses of the LF motor 47 after the detection to control the angular position of the sheet supply roller 5 correctly, the control can be achieved with high accuracy.

Figure 8A:
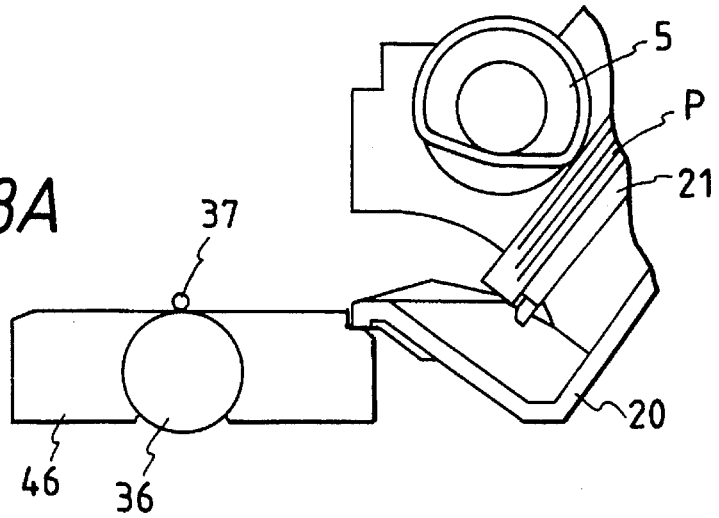
FIGS. 8A to 8C and 9A to 9C are views showing a sheet supplying operation of the sheet supplying apparatus of FIG. 1.

When the sheet supply roller 5 is rotated by about 60 degrees to face the cylindrical portions of the sheet supply roller rubbers 67 to the sheet stack P, the release cam 31 rotated in synchronously with the sheet supply roller 5 releases the pressure plate 21, with the result that the sheet stack P is urged against the sheet supply roller rubbers 67 by the biasing force of the pressure plate springs 22, thereby providing the feeding force for the sheet P (FIG. 8A). In steps S207 and S208, the leading end of the sheet P being fed is detected by the PE sensor 42. If the leading end of the sheet P is not detected by the PE sensor 42 after the sheet supply roller 5 has been rotated by a predetermined amount, since there is no sheet P on the pressure plate 21 or the sheet P has slipped more than a predetermined amount, the program goes to a step S217, where the sheet supply roller 5 is rotated up to the initial position, and the error is displayed (step S218), and then the program is ended (step S219).

Figure 8B:
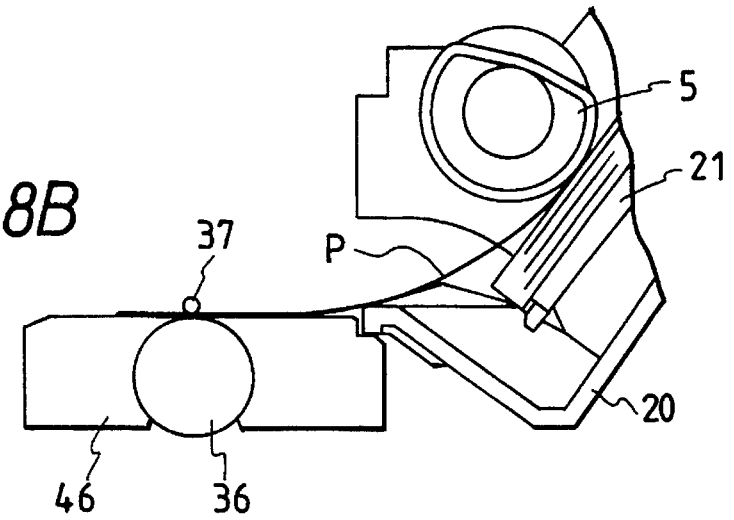

On the other hand, if the PE sensor 42 is turned ON before the sheet supply roller 5 is rotated by the predetermined amount, in a step S209, the angular position of the sheet supply roller 5 when the PE sensor 42 was turned ON and the position of the leading end (tip end) of the sheet are reserved as data N2. Then, in a step S210, the sheet P is fed to the nip between the feed roller 36 and the pinch roller 37 and the heading or protrusion for the registration is effected. In the illustrated 10 embodiment, since the distance between the PE sensor 42 and the nip between the rollers 36, 37 is 7.5 mm and the protruded amount is 3.5 mm, the sheet is fed by 11 mm in total. Then, the sheet supply roller 5 is stopped (FIG. 8B). Then, in a step S211, the feed roller 36 is rotated reversely, thereby leading the tip end of the sheet from the nip between the feed roller 36 and the pinch roller 37. In this case, the return amount of the sheet is about 7 mm (including the protruded amount and the skew-feed amount).

Figure 8C:
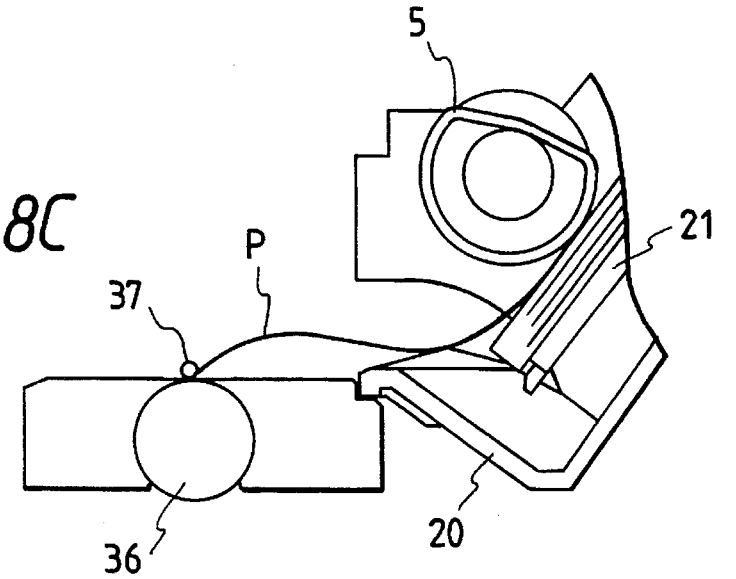

Now, since the planetary gear (not shown) for transmitting the driving force to the sheet supply roller 5 is separated from the input gear 25, the reverse driving force is not transmitted to the sheet supply roller 5. Further, since the sheet supply roller 5 is abutted against the pressure plate 21 via the sheet stack P, when the sheet P is fed reversely for the registration by the feed roller 36, a force for rotating the sheet supply roller 5 reversely is applied to the sheet supply roller by the elasticity of the sheet P. However, since the clutch spring 77 of the clutch gear 29 is tightened, the sheet supply roller 5 is fixed, with the result that the loop is formed in the sheet P by the elasticity of the sheet itself, thereby effecting the registration of the tip end of the sheet (FIG. 8C).

Then, in a step S212, the sheet supply roller 5 is rotated up to the initial position where the D-cut portions of the roller portions 5*c* are opposed to the sheet stack P. During this rotation, the release cam 31 pushes down the push-down portion 21*c* of the pressure plate 21 again, thereby releasing the pressure plate 21 again (FIG. 9A). In this condition, the tip end of the sheet P is protruded from tip ends of nozzles of the recording head 49 by an amount more than a predetermined margin of 1.5 mm. Accordingly, as shown in a step S213, in the illustrated embodiment, by rotating the feed roller 36 reversely, the sheet is returned to a position speed apart from the nip between the feed roller 36 and the pinch roller 37 by 11.5 mm (FIG. 9B). This return amount can be calculated from the aforementioned data N2 regarding the tip end of the sheet. Then, in a step S214, the carriage 50 is shifted to shift the drive switching arm 66 so that the driving force from the feed roller 36 is not transmitted to the sheet supply portion. Then, in a step S215, the feed roller 36 is rotated normally to remove the backlash of the gears and feed the sheet P by 0.7 mm, thereby providing the margin of 1.5 mm between the tip end of the sheet P and the tip ends of the nozzles of the recording head 49 (FIG. 9C).

Next, the control when the sheet supply roller 5 is not in the initial position at the beginning of the sheet supplying operation (trouble case) will be explained.

First of all, in steps S220 to S223, in order to detect the angular position of the sheet supply roller 5, the sheet supply roller 5 is rotated and the angular position of the sheet supply roller 5 is detected by the roller sensor 71. In this case, since it is feared that the sheet P is fed by the rotation of the sheet supply roller 5, the signal of the PE sensor 42 is read. If the PE sensor 42 is turned ON before the roller sensor 71 is turned ON by the sheet supply roller 5, the count of drive pulses of the LF motor 47 is started (N3). In the step S221, the angular position of the sheet supply roller 5 can be detected when the roller sensor 71 is turned ON. In this condition, in a step S224, if N3=0, since the tip end of the sheet P does not yet reach the PE sensor 42, the aforementioned control when the sheet supply roller 5 is in the initial position is permitted, and, thus, the control in the step S205 can be performed.

If the PE sensor 42 is turned ON, the sheet supply roller 5 continues to rotate, and, in steps S225 to S227, the edge of the sensor plate 69 is detected. By counting (N1) the drive pulses of the LF motor 47 after the detection, the angular position of the sheet supply roller 5 can be controlled correctly, thus effecting the control with high accuracy. Further, from the number of the counted drive pulses up to this point (N3), the data regarding the tip end of the sheet (which position is assumed by the tip end of the sheet) is determined, and this data (N4) is reserved.

Then, in a step S228, it is judged whether the tip end of the sheet P reaches the nip between the feed roller 36 and the pinch roller 37 by comparing the data N4 with a predetermined pulse number. If the tip end of the sheet P is positioned between the PE sensor and the feed roller 36, the program goes to a step S229; whereas, if the tip end of the sheet exceeds the feed roller 36, the program goes to a step S236.

First of all, the control regarding the former case will be explained.

Firstly, in the step S229, the sheet supply roller 5 is rotated until the release cam 31 releases the pressure plate 21 and the cylindrical portions of the sheet supply roller rubbers 67 are abutted against the pressure plate 21 via the sheet stack P, and, further, the sheet supply roller 5 is rotated by an amount corresponding to a distance between the tip end of the sheet P and the feed roller 36 in this point plus the protruded amount of 3.5 mm for the registration. Then, similar to the aforementioned step S211, in a step S230, the feed roller 36 is rotated reversely to return the sheet P by 7 mm, thereby effecting the registration.

Then, in a step S231, the sheet supply roller 5 is rotated up to the initial position where the D-cut portions of the roller portions face the sheet P. During this rotation, the release cam 31 pushes down the push-down portion 21*c* of the pressure plate 21, thereby releasing the pressure plate 21. In this condition, the tip end of the sheet P is protruded from the tip ends of the nozzles of the recording head 49 by an amount more than the predetermined margin of 1.5 mm. Accordingly, as shown in a step S232, in the illustrated embodiment, by rotating the feed roller 36 reversely, the sheet is returned to the position spaced apart from the nip between the feed roller 36 and the pinch roller 37 by 11.5 mm. This return amount can be calculated front the aforementioned data N4 regarding the position of the tip end of the sheet at the step S226. Thereafter, since the control is the same as the control when the sheet supply roller 5 is in the initial position, the program goes to the step S214, where the aforementioned control is effected, and then the controls in the steps S215, S216 are effected, and then the program is ended.

Next, the control if the sheet P exceeds the nip between the feed roller 36 and the pinch roller 37 in the step S228 will be explained.

First of all, in a step S233, in order to reduce an amount of the loop in the sheet P for the registration, the sheet supply roller 5 is rotated to an extent that the sheet supply roller rubbers 67 do not contact with the sheet P. Then, in a step S234, the sheet is returned to an amount corresponding to the amount of 7 mm which was protruded from the nip between the feed roller 36 and the pinch roller 37 or more, thereby leaving the tip end of the sheet P from the nip. The amount that the tip end of the sheet P exceeded front the feed roller 36 is calculated from the data N4 regarding the position of the tip end of the sheet at the step S226. In this case, since the sheet P does not contact with the sheet supply roller 5, the sheet P is slipped on the pressure plate 21 or on the sheet stack P rested on the pressure plate, thereby returning the sheet without forming any loop therein.

Then, in a step S235, the sheet supply roller 5 is rotated to feed the sheet P by the protruded amount of 3.5 mm for the registration. Then, similar to the aforementioned step S211, in a step S236, the feed roller 36 is rotated reversely, thereby returning the sheet by 7 mm to effect the registration.

Then, in a step S237, the sheet supply roller 5 is rotated up to the initial position where the D-cut portions of the roller portions face the sheet P. During this rotation, the release cam 31 pushes down the push-down portion 21*c* of the pressure plate 21, thereby releasing the pressure plate 21. In this condition, the tip end of the sheet P is protruded from the tip ends of the nozzles of the recording head 49 by a predetermined amount more than the predetermined margin of 1.5 mm. Accordingly, in a step S238, in the illustrated embodiment, by rotating the feed roller 36 reversely, the sheet is returned to the position spaced apart from the nip between the feed roller 36 and the pinch roller 37 by 11.5 mm. Thereafter, since the control is the same as the control when the sheet supply roller 5 is in the initial position, the program goes to the step S214, where the aforementioned control is effected, and then the controls in the steps S215, S216 are effected, and then the program is ended.

Figure 13:
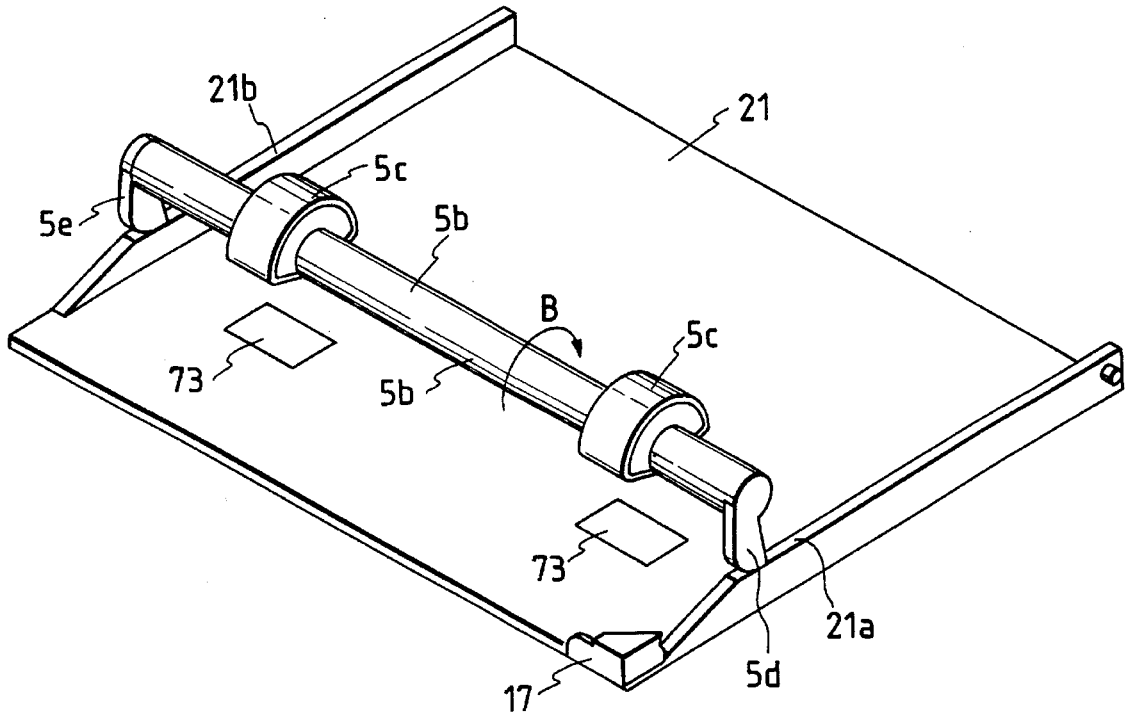
FIG. 13 is a perspective view showing cams for pushing down the pressure plate in the sheet supplying apparatus of FIG. 1.

Next, another embodiment wherein a roller portion 5*c* of the sheet supply roller 5 near a separating claw 17 is firstly abutted against a sheet P will be explained with reference to FIGS. 13 and 14.

Figure 14A:
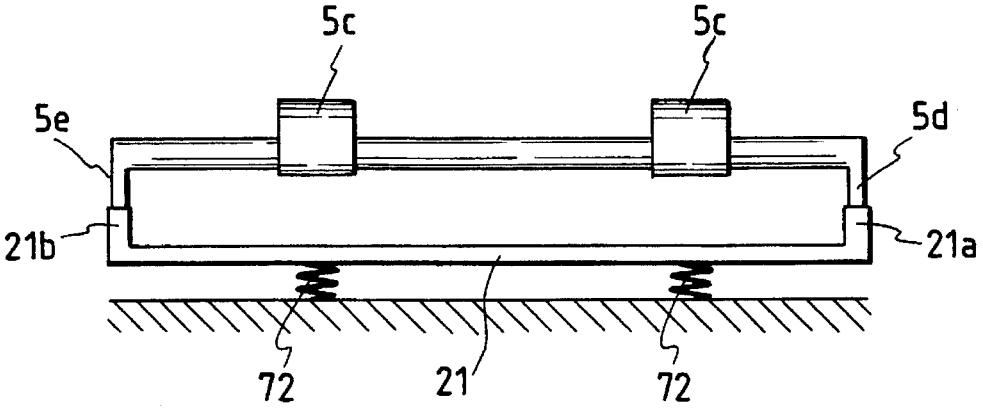
FIGS. 14A and 14B are views showing the operation of the cams of FIG. 13.
Figure 14B:
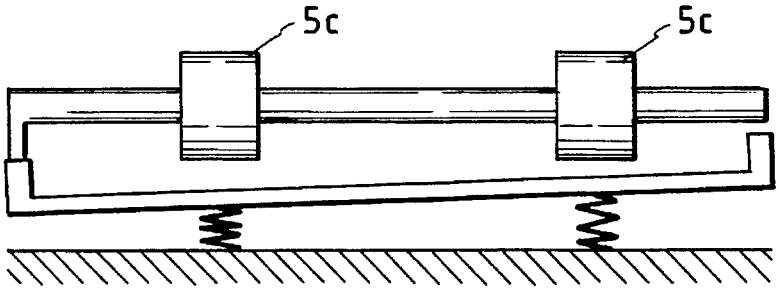

Cam receivers 21*a*, 21*b* for receiving cam portions 5*d*, 5*e* of the sheet supply roller 5 are provided on both sides of the pressure plate 21 so that, other than the sheet supplying operation, as shown in FIG. 14A, the pressure plate 21 is maintained in a lowered condition by the cam portions 5*d*, 5*e* of the sheet supply roller 5. Now, the cam portions 5*d*, 5*e* of sheet supply roller 5 are out of phase with each other so that, when the sheet supply roller 5 is rotated in a direction shown by the arrow B, the cam portion 5*d* near the separating claw 17 is separated from the cam receiver 21*a* before the cam portion 5*e* remote from the separating claw is separated from the cam receiver 21*b*. Accordingly, in a waiting condition that the pressure plate 21 is in a condition shown in FIG. 14A, when the sheet supply roller 5 is rotated by the sheet supply command, as shown in FIG. 14B, due to the difference in phase between the cam portions 5*d*, 5*e*, a portion of the pressure plate 21 near the separating claw 17 is firstly pushed up by the right pressure plate spring 22, thereby firstly abutting the sheet stack P against the roller portion 5*c* near the separating claw 17. Accordingly, also in this embodiment, similar to the aforementioned embodiment, the delay of the sheet due to the resistance of the separating claw 17 during the separating operation can be cancelled, thereby preventing the skew-feed of the sheet and the jamming of the sheet.

A further embodiment will be explained with reference to FIG. 15.

Figure 15:
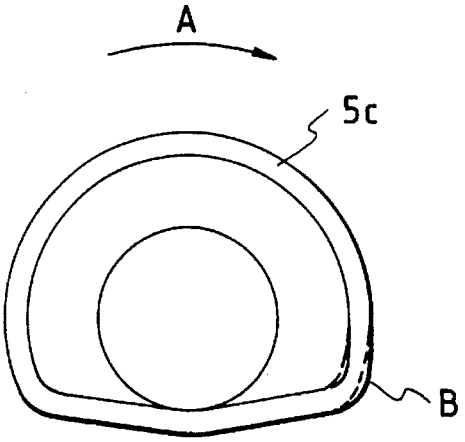
FIG. 15 is a side view of a sheet supply roller according to another embodiment.

FIG. 15 shows a cross-section of a roller portion 5*c* near the separating claw 17 in this embodiment. In the sheet feeding direction shown by the arrow A in FIG. 15, a leading portion (firstly abutted against the sheet P) of the cylindrical portion of the roller portion 5*c* is swelled as shown by B in comparison with the roller portion 5*c* remote from the separating claw 17. Accordingly, in the sheet separating and supplying operation, a feeding amount of a portion of the sheet near the separating claw 17 is increased in comparison with a portion of the sheet remote from the separating claw. Thus, the delay of the sheet due to the resistance of the separating claw 17 can be cancelled, thereby preventing the skew-feed of the sheet and the jamming of the sheet.

Next, a guide member 80 for guiding the sheets P between the separating claw 17 and the pressure plate 21 during the replenishment of the sheets will be explained with reference to FIGS. 16 to 21.

Figure 16:
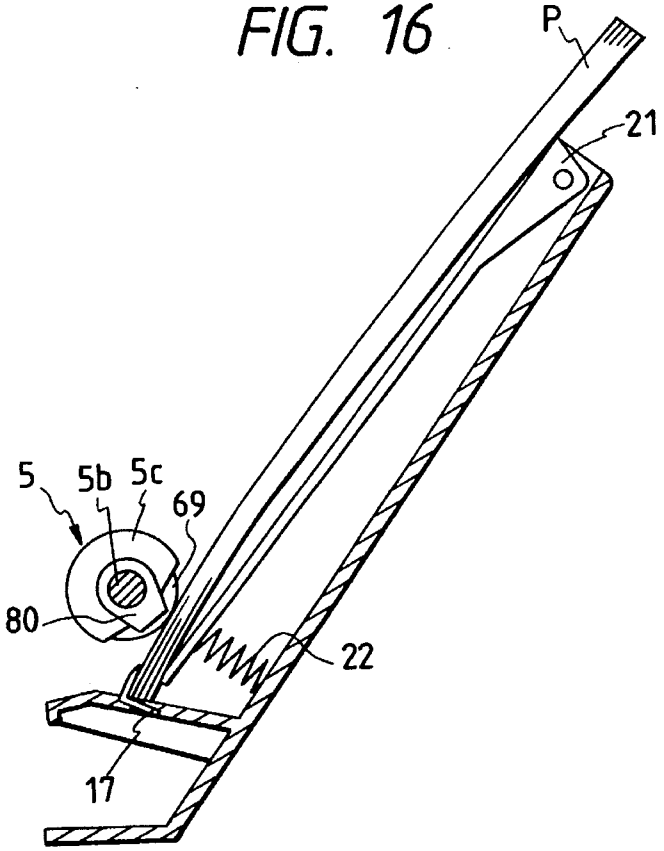
FIG. 16 is a longitudinal sectional view of a sheet supplying apparatus according to another embodiment.

In FIG. 16, the guide member 80 is integrally secured to the shaft portion 5*b* of the sheet supply roller 5 in the vicinity of the separating claw 17 so that it can be rotated together with the shaft portion 5*b*.

Figure 17:
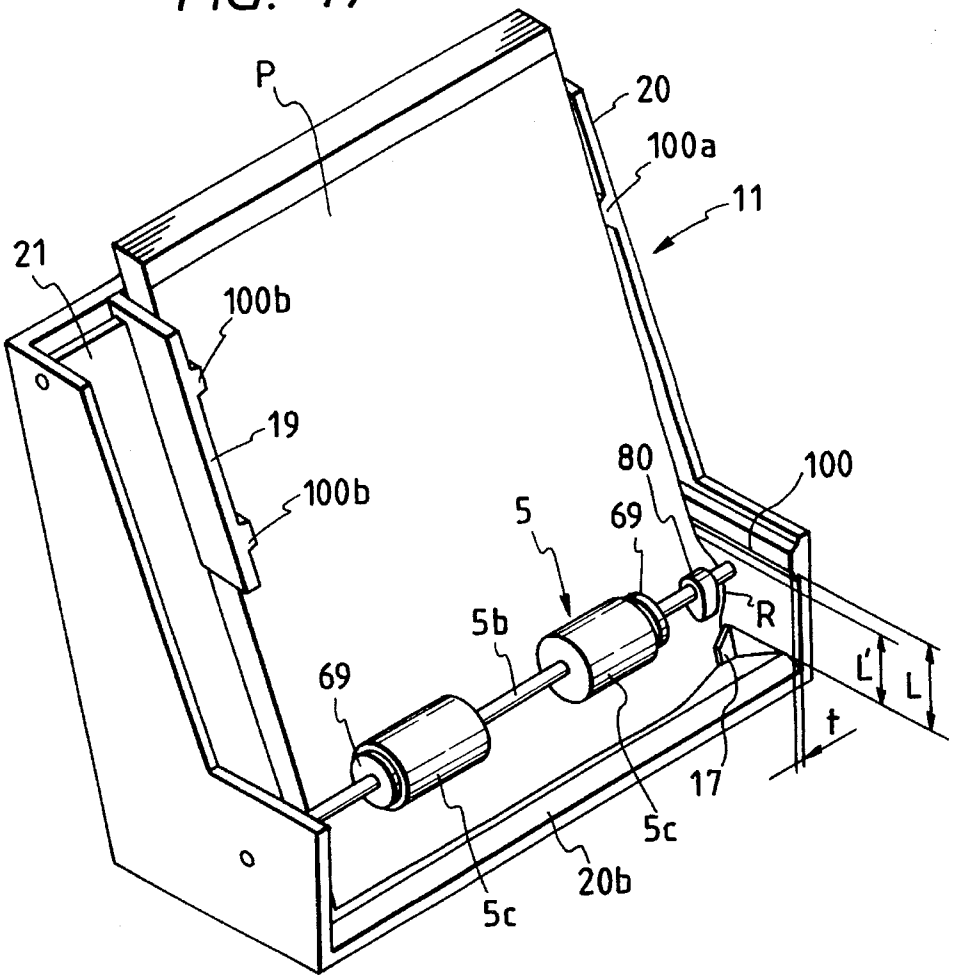
FIG. 17 is a perspective view of the sheet supplying apparatus of FIG. 16.

FIG. 17 shows a condition that the sheet P is fed by a small amount immediately after the sheet supply roller 5 starts to rotate. In this condition, the deflection R is formed in the sheet portion near the separating claw 17. In this case, since the guide member 80 was rotated together with the sheet supply roller 5, it does not contact with the deflection R.

Figure 18A:
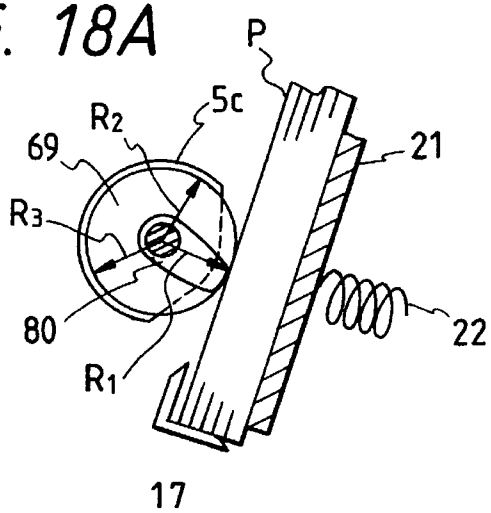
FIGS. 18A and 18B are views showing a sheet supplying operation effected by sheet supply rollers of the sheet supplying apparatus of FIG. 16.
Figure 18B:
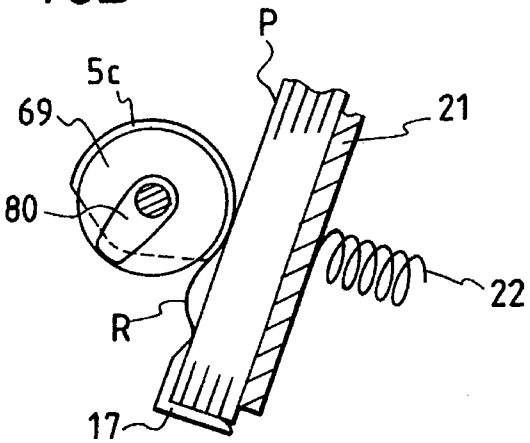

FIGS. 18A and 18B show a relation between the guide member 80 and the deflection R in the sheet P during the separating operation. Particularly, FIG. 18A shows a waiting condition, and FIG. 18B shows a condition immediately after the separating operation is started. In this condition, the guide member 80 is separated from the deflection R in the sheet P completely.

Further, when a distance between a center of the sheet supply roller 5 and a furthermost portion of the guide member 80 is $R_1$, a radius of the cylindrical portion of the sheet supply roller 5 is $R_2$ and a radius of the roller 69 for preventing the contact between the sheet P and the sheet supply roller 5 after the sheet supplying operation is $R_3$, the following relation is established:

$$R_1 \leq R_3 < R_2$$

Figure 19:
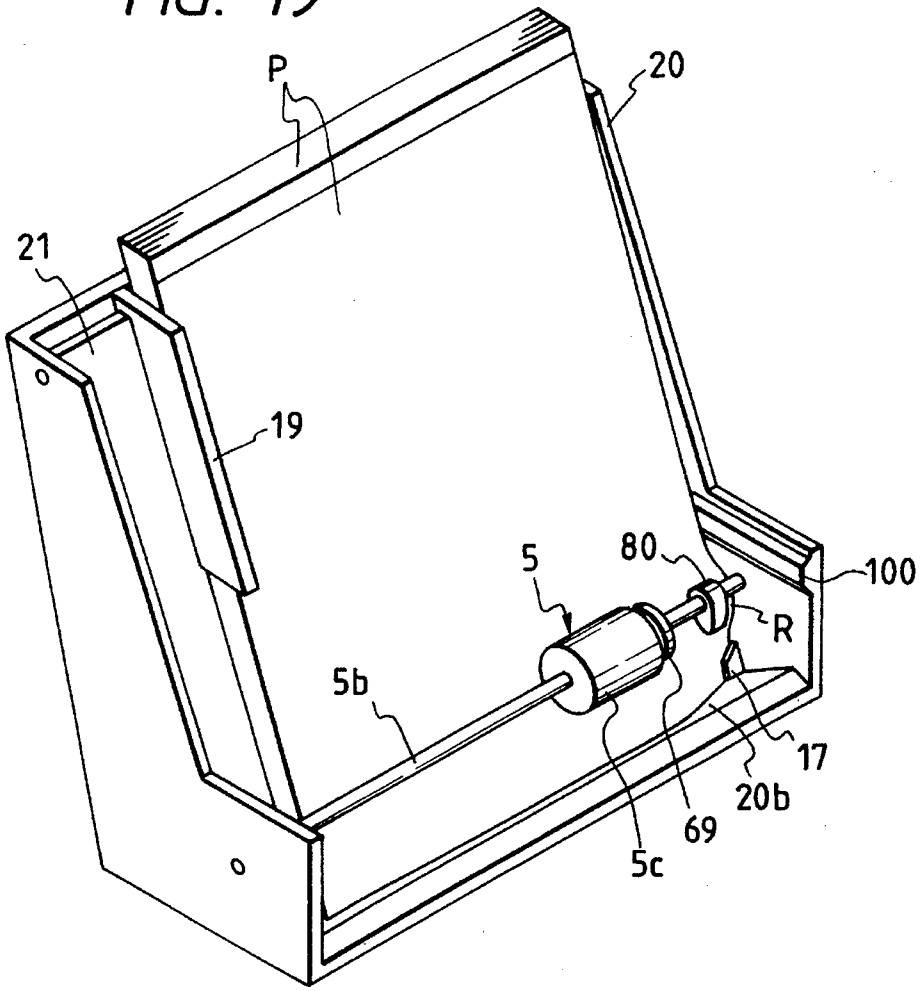
FIG. 19 is a perspective view of a sheet supplying apparatus according to a further embodiment.

FIG. 19 shows an example that only one roller portion 5*c* of the sheet supply roller 5 is provided near the separating claw 17.

Figure 20A:
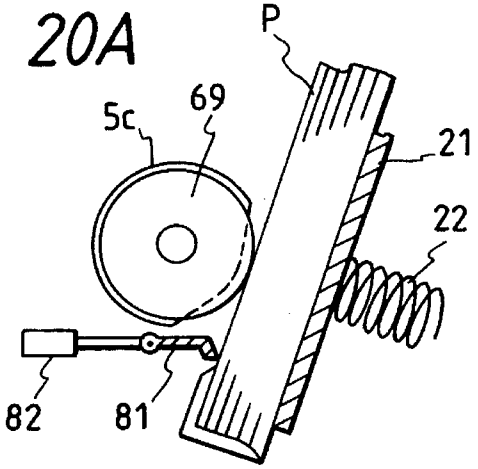
FIGS. 20A and 20B are views showing a sheet supplying operation effected by sheet supply rollers of the sheet supplying apparatus of FIG. 19.
Figure 20B:
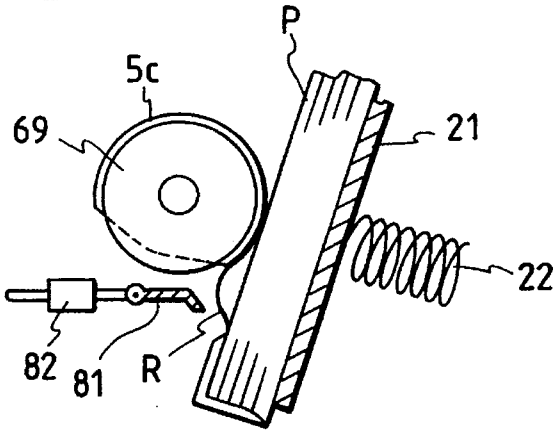

FIGS. 20A and 20B show an example that, in place of the guide member 80, a movable guide member 81 driven by a solenoid 82 is provided. In the non-sheet supplying condition, as shown in FIG. 20A, the guide member 81 is positioned just above the separating claw 17 so that the guide member 81 serves as a guide for guiding the insertion of the sheets P. When the sheet supplying operation is started, as shown in FIG. 20B, the guide member 81 is retarded from the separating claw by energizing the solenoid 82, thereby preventing the contact between the guide member and the deflection R in the sheet.

Figure 21:
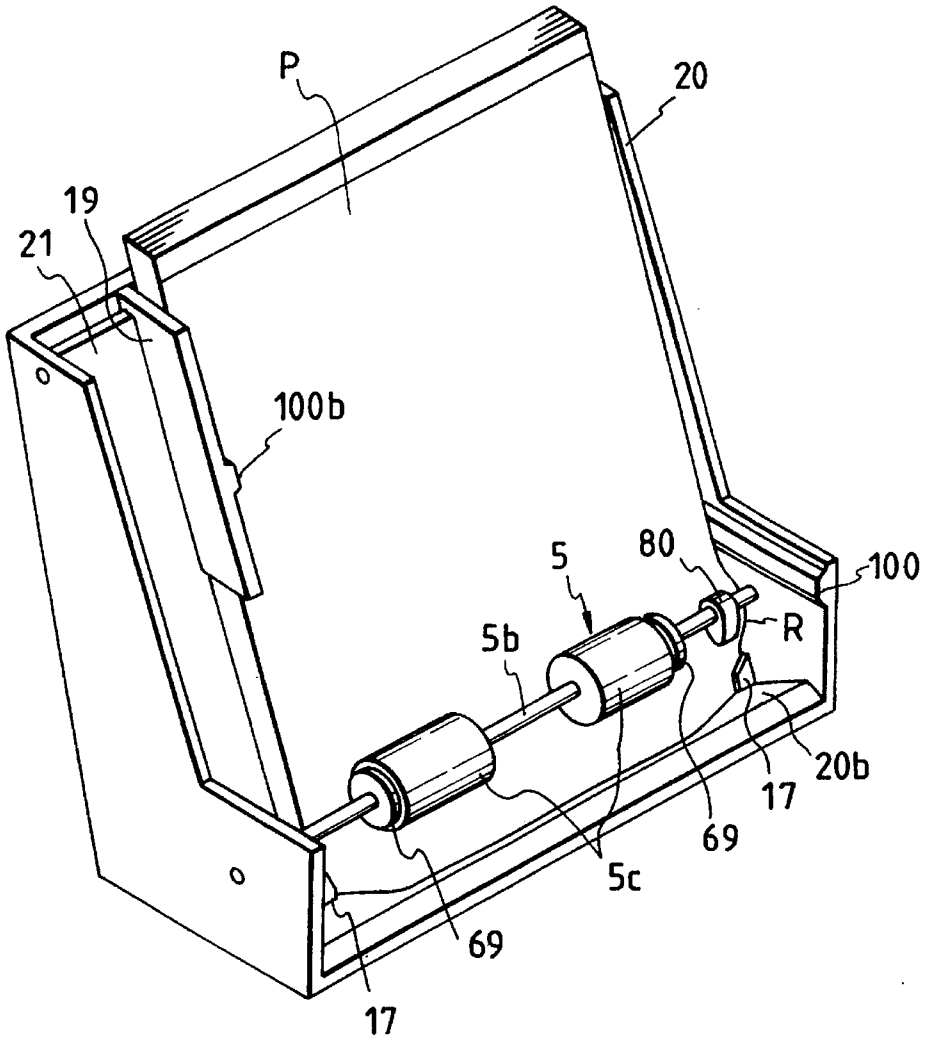
FIG. 21 is a perspective view of a sheet supplying apparatus according to a still further embodiment.

FIG. 21 shows an example that separating claw 17 are provided on both sides.

Figure 22:
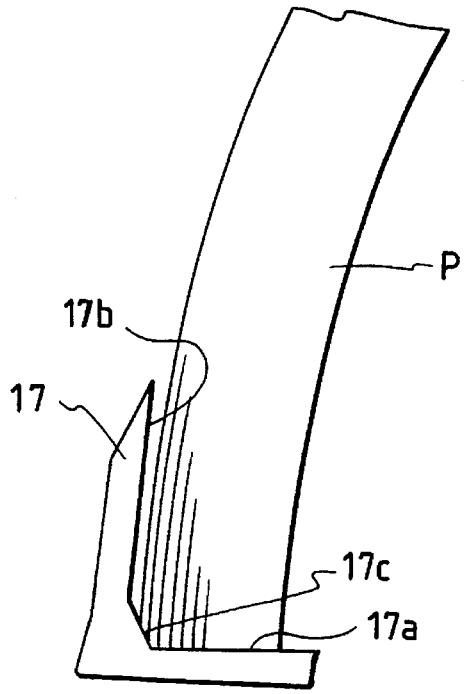
FIG. 22 is a view showing an arrangement wherein a contiguous surface is provided at a corner of a separating claw.

FIG. 22 shows a configuration of the separating claw 17 used in the aforementioned embodiments. In the conventional separating claws, there arose problems that the front corners of the sheets were penetrated into the corners (of the separating claws) formed between the front walls for supporting the leading end of the sheet stack and the top surface for holding down the upper surface of the sheet stack, thereby causing the poor separation, and that, in case of the single separating claw arranged only at one side, the sheet separation was delayed so that a portion of the sheet remote from the separating claw was fed firstly, thereby causing the skew-feed.

To avoid this, as shown in FIG. 22, an inclined surface 17*c* is formed at a corner between a side surface 17*a* of the separating claw 17 for supporting the leading end of the sheet stack P and a top surface 17*b* of the separating claw for holding down the upper surface of the sheet stack P, thereby preventing the penetration of the front corners of the sheets P. Incidentally, the inclined surface 17*c* may be concave or convex.

Figure 23A:
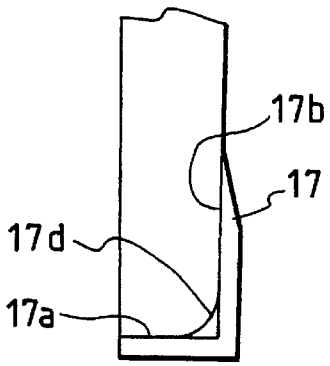
FIGS. 23A and 23B are views showing a separating claw according to another embodiment.
Figure 23B:
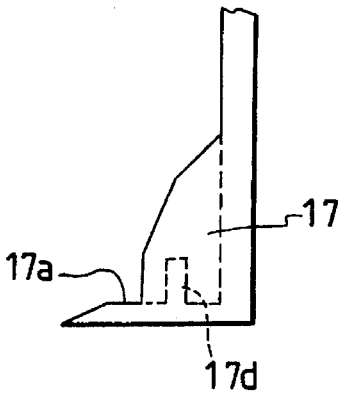

In a separating claw 17 shown in FIGS. 23A and 23B, a concave rib 17*d* is formed at the corner of the separating claw so that the penetration of the sheets P is prevented by this rib.

Figure 24A:
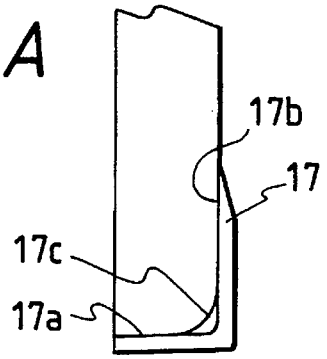
FIGS. 24A to 24E are views showing a separating claw according to a further embodiment.
Figure 24B:
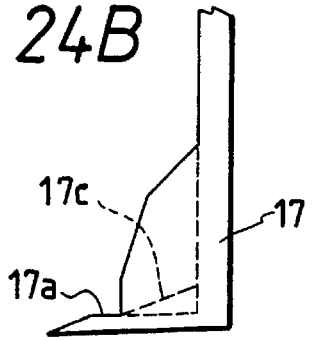
Figure 24C:
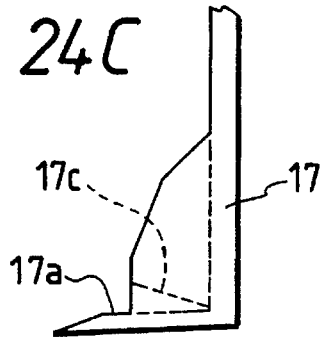
Figure 24D:
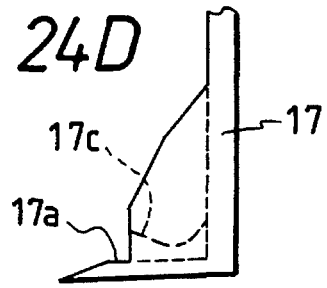
Figure 24E:
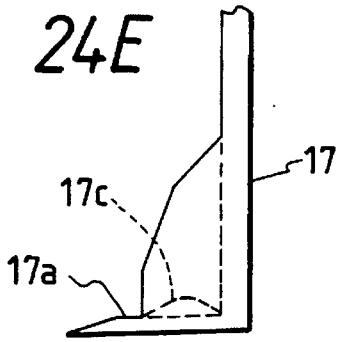

FIGS. 24A to 24E show various shapes of the inclined surfaces 17*c*, where FIG. 24B shows an inclined surface having an inside (near the side wall of the separating claw) higher than an outside, FIG. 24C shows an inclined surface having the outside higher than the inside, FIG. 24D shows an inclined surface which is concave at a central portion, and FIG. 24E shows an inclined surface which is convex at a central portion. Incidentally, each of these inclined surfaces has a side configuration as shown in FIG. 24A.

Next, in a sheet supplying apparatus in which a separating claw is provided only at one side, a means for solving a problem that the correct sheet supply and separation are prevented by inclining and deviating the ends (remote from the separating claw) of the sheets downwardly due to the vibration and/or the friction between the sheets will be explained.

Figure 25:
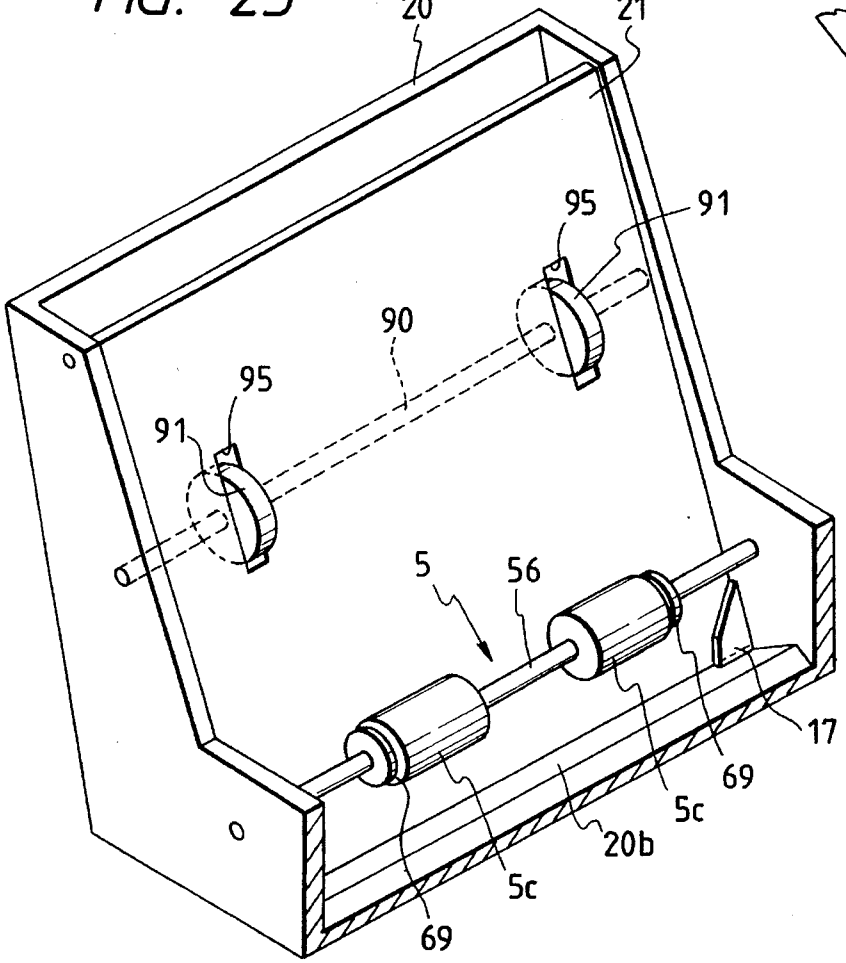
FIG. 25 is a perspective view of a sheet supplying apparatus according to a further embodiment.

FIG. 25 is a perspective view of an automatic sheet supplying apparatus.

Figure 26:
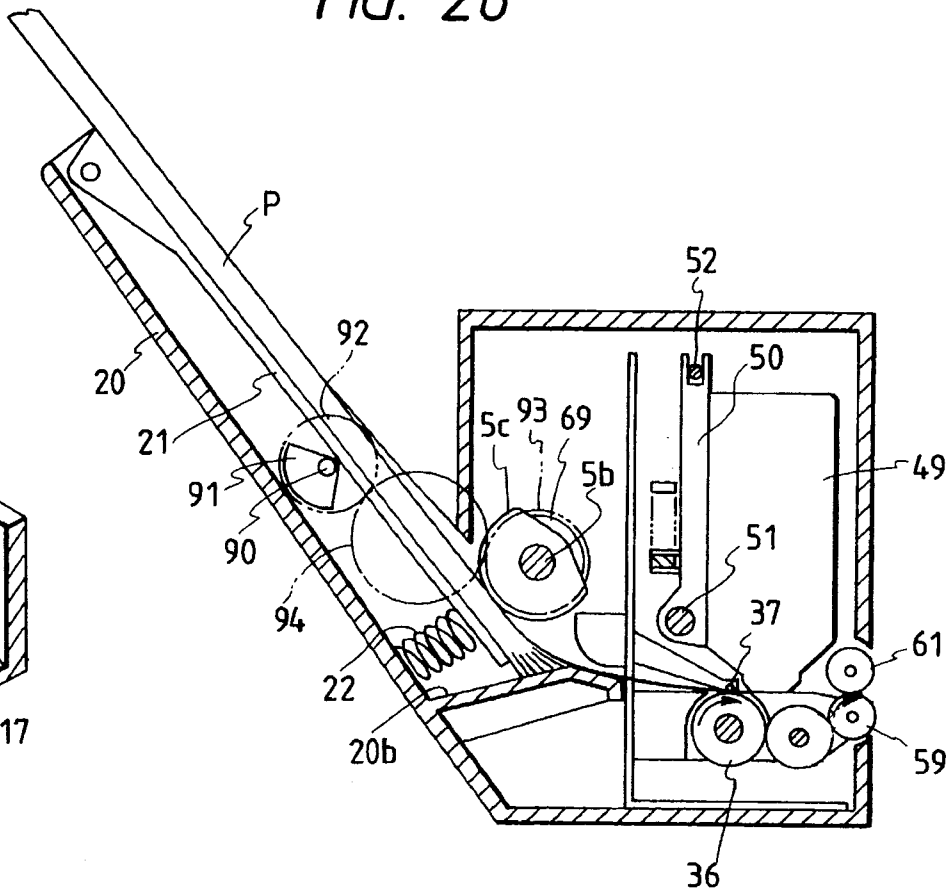
FIG. 26 is a longitudinal sectional view of a printer incorporating the sheet supplying apparatus of FIG. 25.
Figure 27:
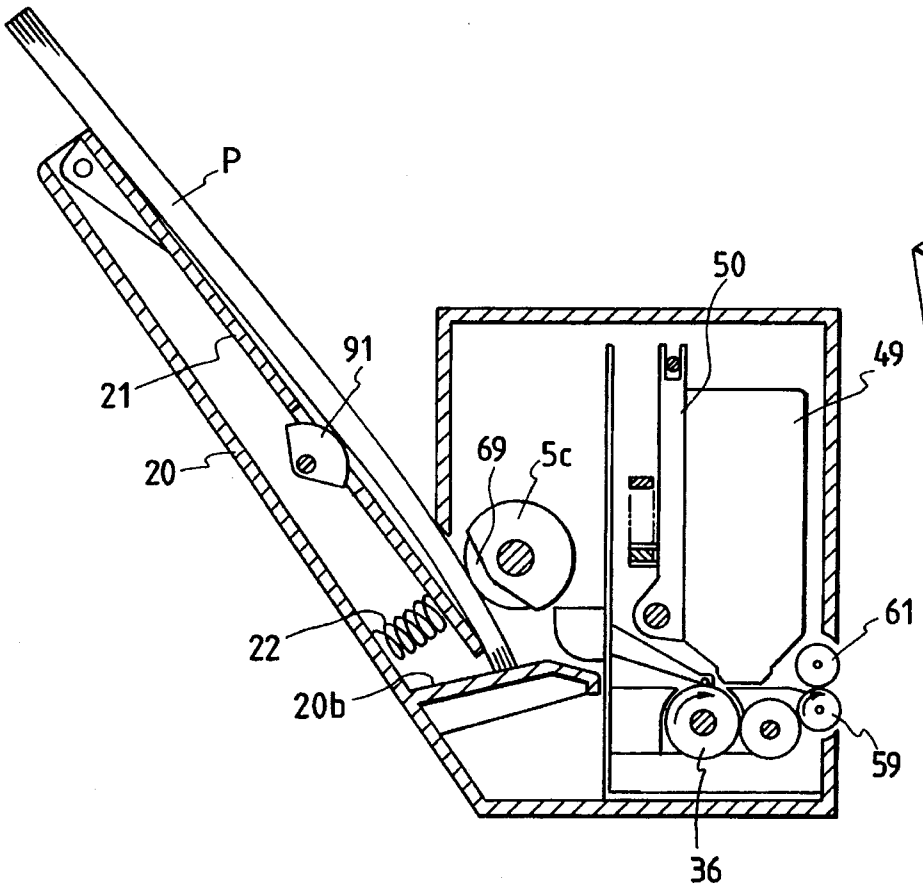
FIG. 27 is a sectional view showing a condition that a push-out member is being operated in the printer of FIG. 26.

FIGS. 26 and 27 are sectional views of the automatic sheet supplying apparatus looked at from a side that the separating claw 17 is not provided, showing a condition that the sheets are being separated.

A pair of pusher sectors 91 and a push-up gear 92 are secured to a support shaft 90 rotatably mounted on the base 20. A sheet supply roller gear 93 secured to the shaft portion 5*b* of the sheet supply roller 5 is connected to the push-up gear 92 via an intermediate gear 94, so that the push-up gear can be driven synchronously with the sheet supply roller 5.

On the way that the sheets P are being separated, as shown in FIG. 26, the pusher sectors 91 are retracted below the pressure plate 21, and the sheet stack P is abutted against an inclined guide surface 20*b* with the low resistance. In this condition, when the sheets P are separated, since the leading end of the sheet stack P is not regulated by the separating claw 17 (unlike to the other side that the separating claw is disposed), the sheet stack advances toward a downstream side of the inclined guide surface 20*b*, with the result that the sheet stack is rested inclined with respect to the automatic sheet supplying apparatus, and, the poor feeding such as the skew-feed is apt to occur accordingly. However, in the illustrated embodiment, at the end of the separation, i.e., when the sheet supply roller 5 is rotated at a position as shown in FIG. 27, the pusher sectors 91 are also rotated to protrude from openings formed in the pressure plate 21, thus pushing the back surface of the sheet stack P upwardly.

Consequently, the lifted sheet stack P is abutted against the rollers (also serving as the sensor plates) 69, thereby rotating the sheet stack around the rollers 69. As a result, the leading end of the sheet stack P is lowered toward the pressure plate 21, so that the leading end of the sheet stack P is abutted against the inclined guide surface 20*b* substantially perpendicularly, thereby preventing the sheet stack from the shifting toward the downstream side of the inclined guide surface.

Further, in the illustrated embodiment, when thick sheets such as post cards or sheets having high rigidity are set, such sheets P are set in front of the separating claw 17 while not being hooked by the separating claw 17, and, in place of the separating claw 17, the inclined surface 20*b* is used as the regulating or separating means. In this case, the sheets P are separated one by one by utilizing the resistance generated by abutting the sheet stack against the inclined guide surface 20*b* at an angle.

Figure 28:
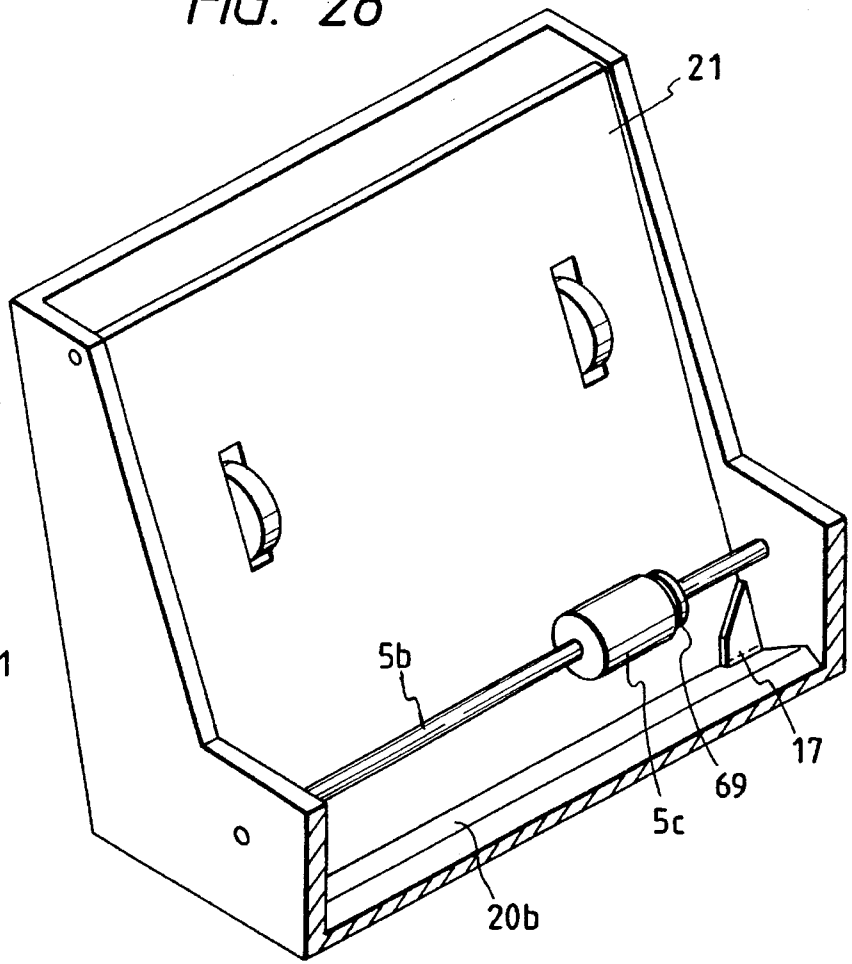
FIG. 28 is a perspective view of a sheet supplying apparatus according to a further embodiment.

FIG. 28 shows an example that the sheet supply roller 5 has a single roller portion 5*c*.

Figure 29:
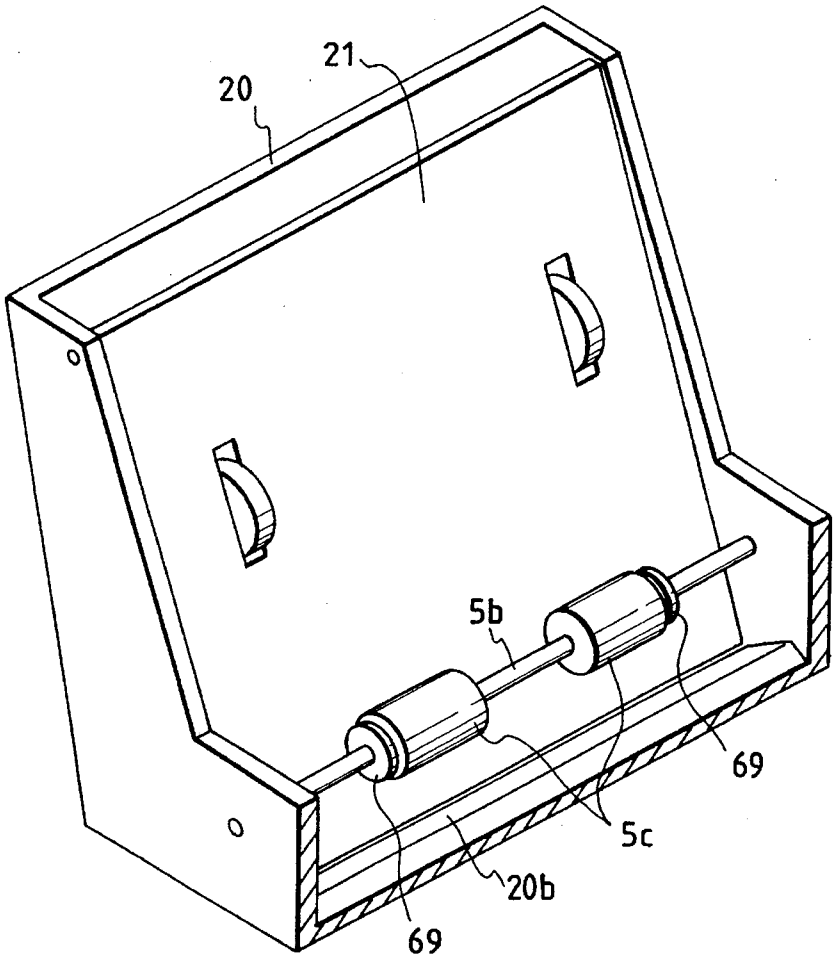
FIG. 29 is a perspective view of a sheet supplying apparatus according to a still further embodiment.

FIG. 29 shows an example that, in an automatic sheet supplying apparatus exclusively using thick sheets such as post cards or sheets having high rigidity, any separating claw is not used as a regulating means, but the sheets P are separated one by one by utilizing the resistance generated by abutting the sheet stack against an inclined guide surface 20*b* at an acute angle.

Figure 30:
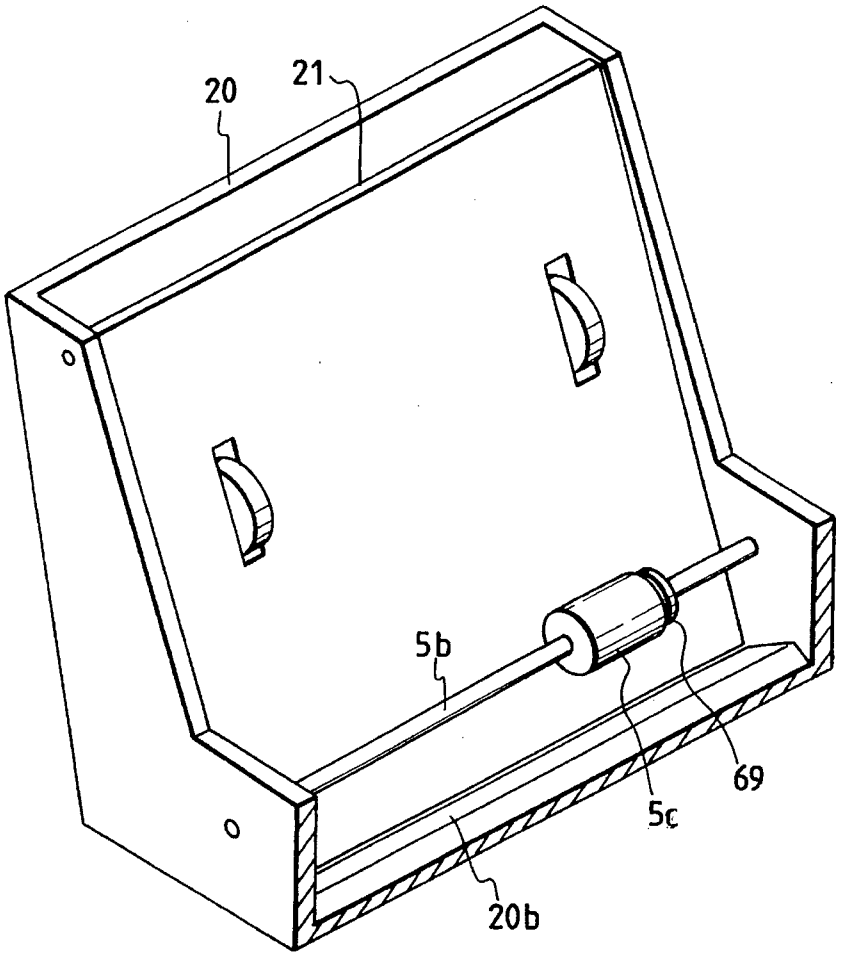
FIG. 30 is a perspective view of a sheet supplying apparatus according to a further embodiment.

FIG. 30 shows an example that, in an automatic sheet supplying apparatus exclusively using thick sheets such as post cards or sheets having high rigidity, a separating claw is not used as a regulating means, but the sheets P are separated one by one by utilizing the resistance generated by abutting the sheet stack against an inclined guide surface 20*b* at an acute angle, and the sheet supply roller 5 has a single roller portion 5*c*.

Next, in the case where the sheets are guided by using an inner wall at one side as a reference, a means for preventing the poor feeding and/or the skew-feed which would be caused by the unstable sheet feeding condition generated by the increases in the sheet separating load due to the sliding resistance between the sheets and the inner wall and/or the fluctuation of the sliding resistance depending upon the contacting condition between the sheets and the inner wall will be explained.

In FIG. 17, a protruded portion 100 is protruded from an inner surface of the side plate of the base 20 of the automatic sheet supplying apparatus by a protruding amount of t. The protruded portion 100 is spaced apart from the separating claw 17 at an upstream side thereof in the sheet feeding direction by a distance L.

As shown in FIG. 17, a corner portion (near the separating claw) of the sheet P fed by the sheet supply roller 5 starts to deflect and then rides over the separating claw 17 to be fed forwardly. When a distance between an upstream end of the deflection and the separating claw 17 is L', a relation $L \geqq L'$ is established, so that the sheet P is subjected to the minimum sliding resistance during the sheet separation to create the natural deflection in the sheet, thereby separating and feeding of the sheet smoothly.

Further, a plurality of protruded portions 100*a*, 100*b* may be formed on the side plate of the base 20 and the movable side guide 19 movable in the widthwise direction of the base 20.

FIG. 19 shows an example that a single roller portion 5*c* of the sheet supply roller 5 is used.

FIG. 21 shows an example that separation claws 17 are provided on both sides of the automatic sheet supplying apparatus.

Figure 31:
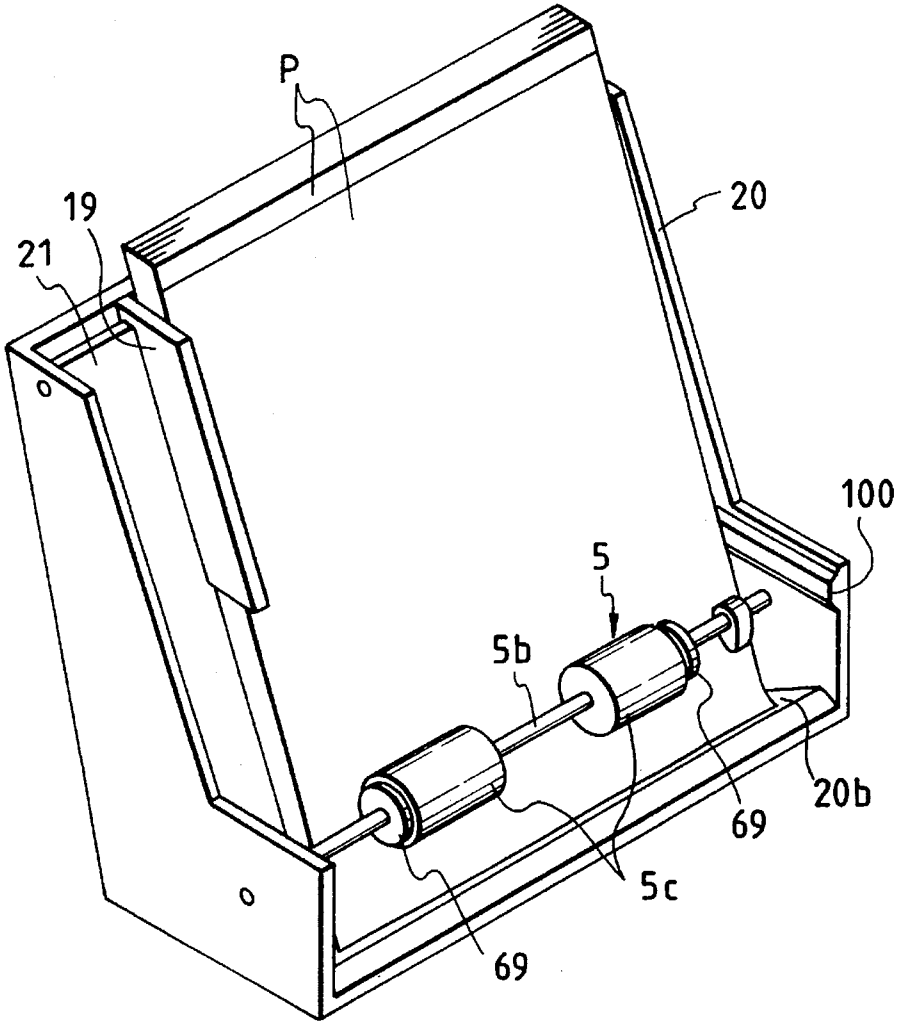
FIG. 31 is a perspective view of a sheet supplying apparatus according to a still further embodiment.

FIG. 31 shows an example that, in an automatic sheet supplying apparatus exclusively using thick sheets such as post cards or sheets having high rigidity, a separating claw is not used as a regulating means, but the sheets P are separated one by one by utilizing the resistance generated by abutting the sheet stack against an inclined guide surface 20*b* at an acute angle.

Figure 32B:
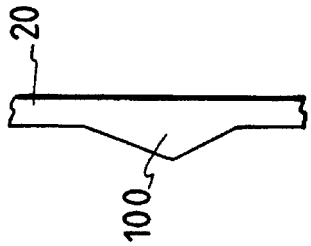
FIGS. 32A and 32B are views showing a configuration of a projection formed on a side wall.
Figure 32A:
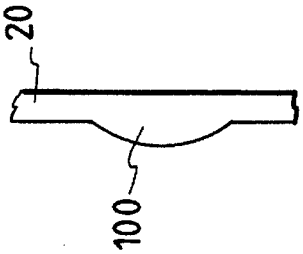

FIGS. 32A and 32B show other configurations of the protruded portion 100, where FIG. 32A shows a protruded portion having a semi-circular cross section and FIG. 32B shows a protruded portion having a triangular cross-section. In any case, the protruded portion may be shaped to facilitate the movement of the sheet.

Next, in an automatic sheet feeding apparatus wherein a separating claw 17 is provided only at one side, a means for stably feeding a sheet without skew-feed will be explained with reference to FIGS. 33 to 51.

Figure 33:
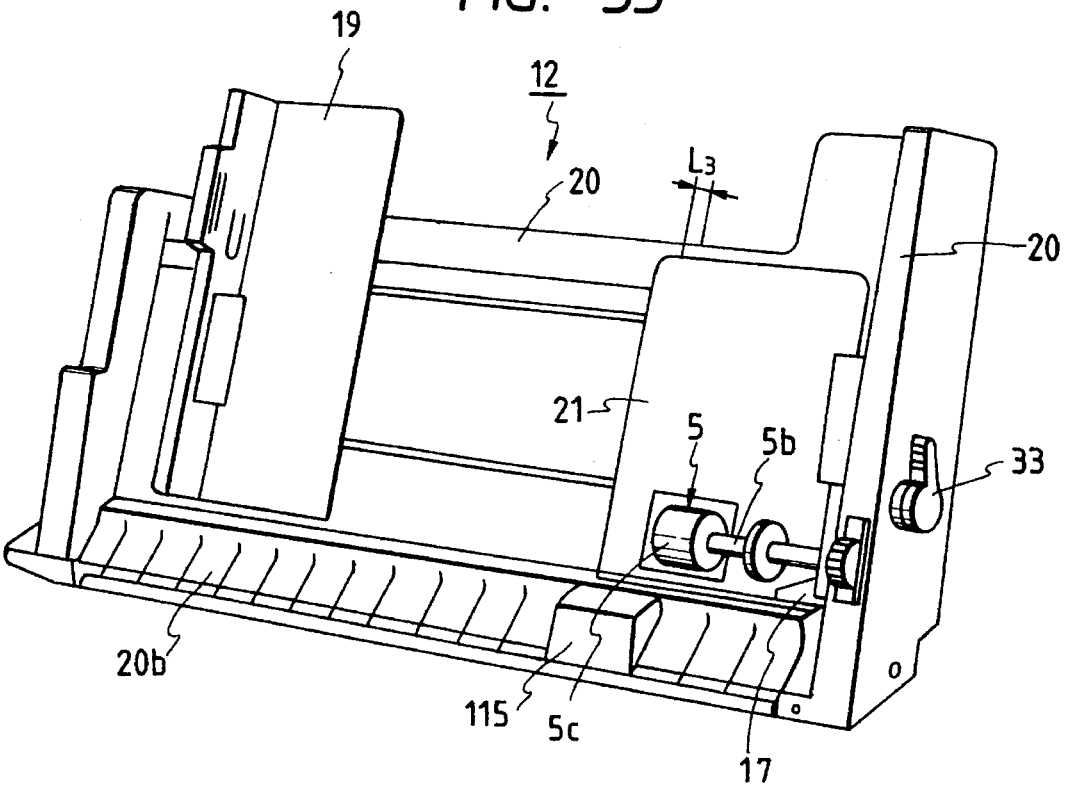
FIG. 33 is a perspective view of a sheet supplying apparatus according to a further embodiment.

First of all, the positional relation of a sheet supply portion 12 will be described with reference to FIGS. 33 and 34. Although the position of a pressure plate 21 is changed in dependence upon a thickness of a sheet stack P set on the pressure plate, a hight difference $L_3$ between a fixed portion of a base 20 on which the sheet stack P is set and the pressure plate 21 is selected to have a value of 0 to 10 mm ($=L_3$) so that the pressure plate 21 is always above the fixed portion. With such height difference, the friction due to the contact is minimized, thus reducing the load on the sheet stack P and improving the positional relation between the sheet stack P and a sheet supply roller 5 to permit the smooth sheet supplying without skew-feed.

Figure 34:
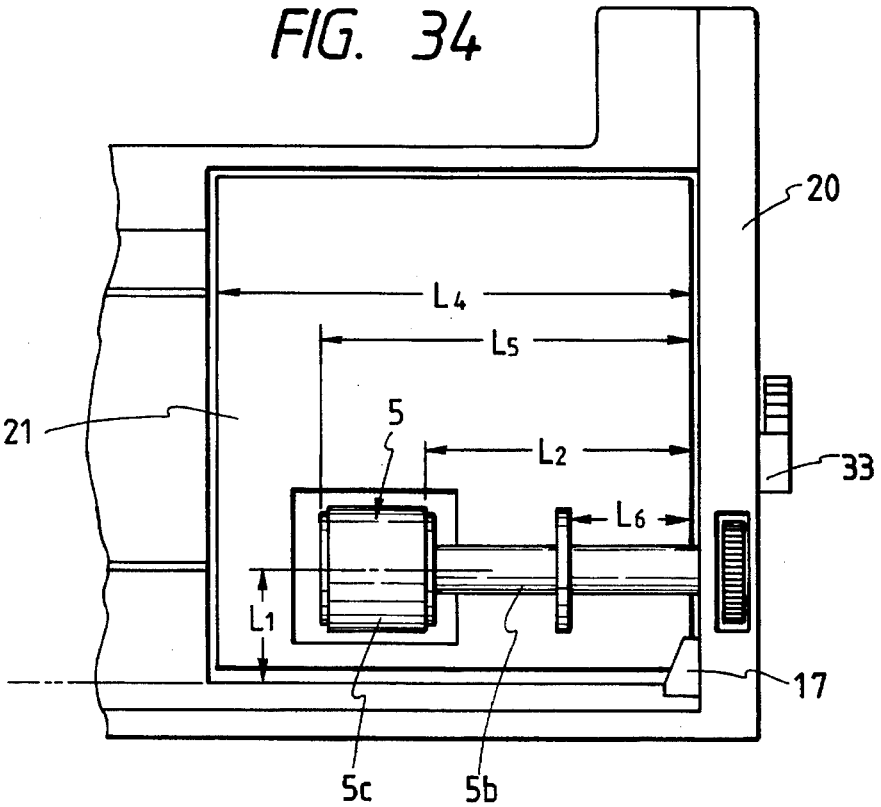
FIG. 34 is a partial front view of the sheet supplying apparatus of FIG. 33.

Further, as shown in FIG. 34, a width $L_4$ of the pressure plate 21 is greater than a distance $L_5$ between an outer end of the pressure plate and an inner end of the sheet supply roller 5 and is selected to a predetermined width smaller than the minimum size of available sheets.

A width of a sheet supply roller portion 5*c* is about 20 mm, a distance $L_1$ (FIG. 34) between an inclined plate 115 of a lower guide portion 20*b* and an rotation axis of the sheet supply roller 5 is 20 to 30 mm, and a distance $L_2$ between a side wall of the base 20 and an inner end of the sheet supply roller 5 is about 40 to 60 mm in case of an A4 (length) size sheet. With this arrangement of the sheet supply roller 5, if the distance $L_1$ is too great or too small, the relation between the sheet supply roller, and the lower guide portion 20*b* and a separating claw 17 is worsened, thus easily causing the scratching of the separating claw, double-feed and/or jamming of the sheet. Therefore, the distance $L_1$ is normally properly selected between 5 to 50 mm. Further, regarding the distance $L_2$, in order to prevent the skew-feed of the sheet, although the roller portion 5*c* of the sheet supply roller 5 is preferably positioned at a center of the sheet P, this distance $L_2$ may be properly selected between 20 mm and a half of the maximum sheet width.

With the arrangement as mentioned above, as shown in FIG. 35, with respect to the sheet feeding direction (shown by the arrow K1), an abutment portion 17*a* of the separating claw 17 is positioned at a downstream side (below in FIG. 35) of a receiving portion 115*a* of the inclined plate 115.

Figure 37:
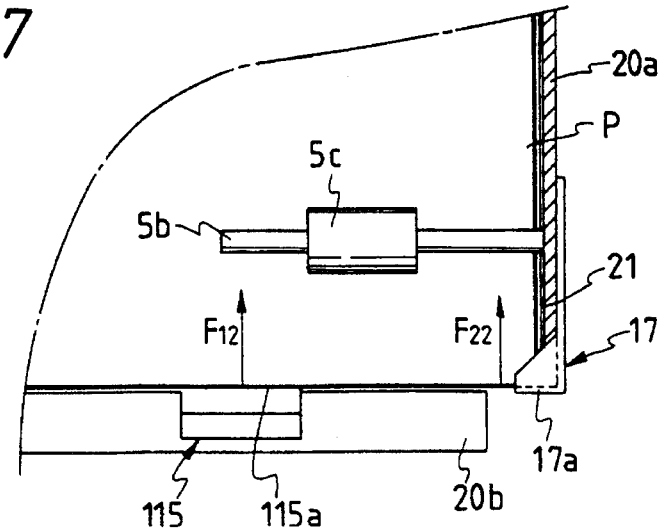

As shown in FIG. 37, if the abutment portion 17*a* of the separating claw 17 is positioned in flush with or at an upstream side (above in FIG. 37) of the receiving portion 115*a* of the inclined plate 115 as in the conventional case, a leading end of the sheet P is subjected to a resistance force F22 from the abutment portion 17*a*. Consequently, the left side (FIG. 37) of the sheet P is firstly fed, thus causing the skew-feed.

Further, if the abutment portion 17*a* of the separating claw 17 is positioned above the receiving portion 115*a* of the inclined plate 115, in the one side claw separation, whenever the sheet separations are repeated, the end of the sheet stack P opposite to the separating claw 17 is gradually shifted in the sheet feeding direction (shown by the arrow K1)(since there is no receiver for the sheet stack in the opposite side at a position corresponding to the abutment portion 15*a* of the separating claw 17). As a result, in this condition, when the sheet P is fed by rotating the sheet supply roller 5, the sheet P is penetrated into the separating claw 17, so that the sheet is subjected to the greater force from the separating claw 17.

Figure 35:
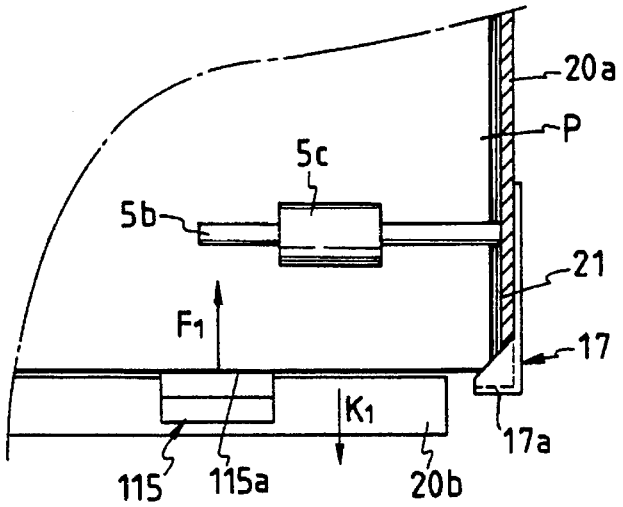
FIGS. 35 to 37 are partial front views showing a sheet separating operation effected by the sheet supplying apparatus of FIG. 33.

To avoid this, according to the illustrated embodiment, as shown in FIG. 35, at the beginning of the sheet separation, the leading end of the sheet stack P is not contacted with the abutment portion 17*a* of the separating claw 17, and, thus, the front corner (near the separating claw 17) of the sheet stack P is not subjected to the force from the separating claw, thereby permitting the smooth sheet separation.

Figure 36:
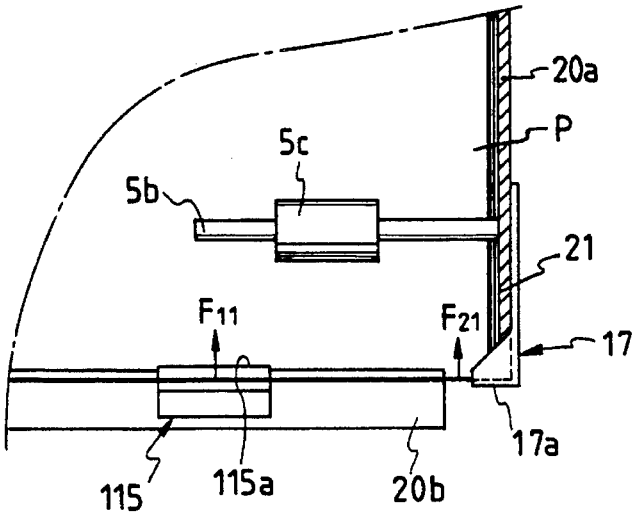

Consequently, as shown in FIG. 36, the sheet is fed up to the abutment portion 17*a* of the separation claw 17 without the skew-feed. At this point, the sheet P begins to contact with the abutment portion 17*a* and is subjected to a resistance force F21. However, in this case, since the sheet P is shifted, the resistance force F21 is considerably smaller than the resistance force F22 acting in the condition shown in FIG. 37, with the result that the difference in resistance between the left and right sides of the sheet is reduced, thereby permitting the feeding of the sheet without skew-feed.

Figure 38:
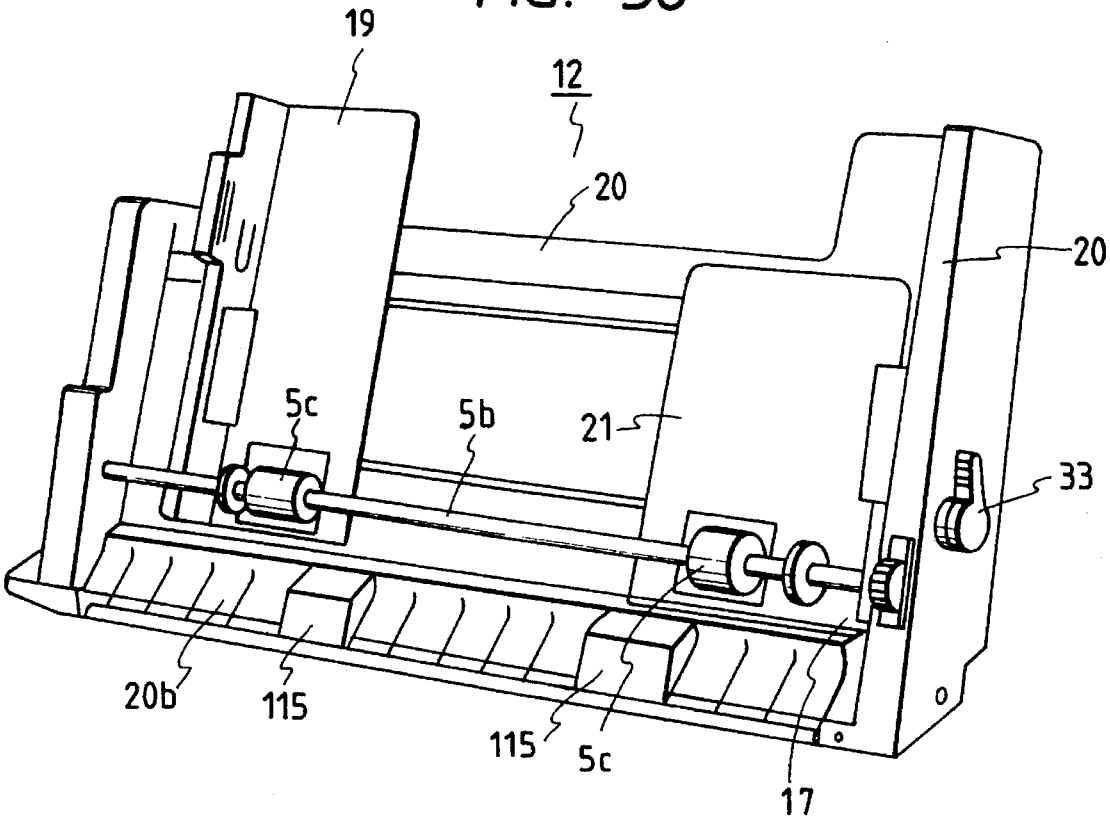
FIG. 38 is a perspective view of a sheet supplying apparatus according to a still further embodiment.

While the single roller portion 5*c* of the sheet supply roller 5 and the single inclined plate 115 were provided in the previous example, in an example shown in FIG. 38, a plurality of (two in the illustrated example) roller portions 5*c* of the sheet supply roller 5 and inclined plates 115 are provided. Also with this arrangement, by selecting the positional relation between the separating claw 17 and the roller portions 5*c* to the same as the aforementioned case, the same advantage can be obtained.

Next, a further example will be explained with reference to FIGS. 39 and 40.

Figure 39:
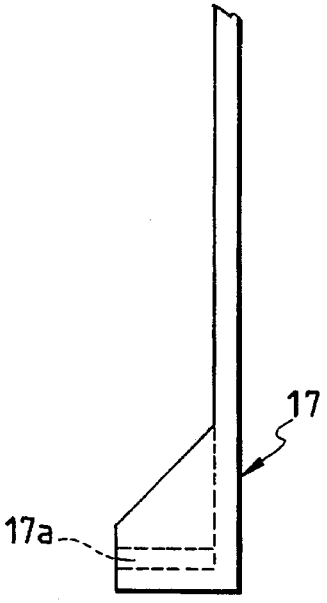
FIG. 39 is a front view showing a configuration of a separating claw.
Figure 40:
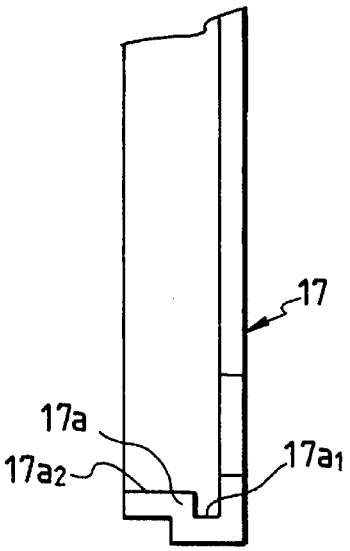
FIG. 40 is a side view showing a configuration of the separating claw.

FIG. 39 is a front view of a main portion of a separating claw 17, and FIG. 40 is a side view of the separating claw. As shown in FIG. 40, an abutment portion 17*a* of the separating claw 17 is constituted by two steps so that a first step 17*a*1 of the separating claw 17 is positioned below the receiving portion 115*a* of the inclined plate 115, thereby obtaining the same advantage as the previous example. Further, since the sheets P can be stacked by a second step 17*a*2 of the abutment portion 17*a*, the sheet stacking ability can be improved in comparison with the previous example.

Figure 41:
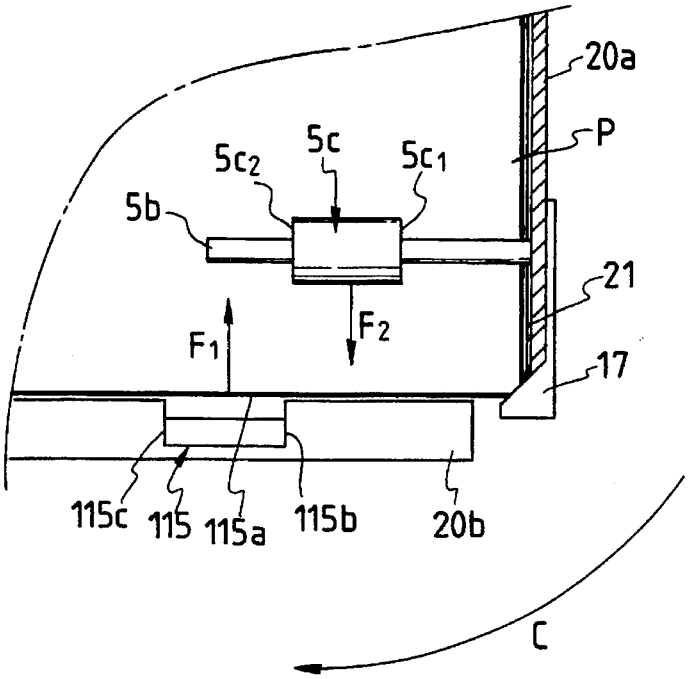
FIG. 41 is a partial front view of the sheet supplying apparatus of FIG. 33.

In this example, as shown in FIG. 41, an outer end (right end in FIG. 41) 5*c*1 of the roller portion 5*c* of the sheet supply roller 5 near the separating claw 17 and an inner end (left end) 5*c*2 of the roller portion 5*c* are positioned nearer to the separating claw 17 in comparison with an outer end (right end) 115*b* of the inclined plate 115 and an inner end (left end) 115*c* of the inclined plate. With this arrangement, when the sheet P is fed downwardly in FIG. 41 by the sheet supply roller 5, the sheet P below the sheet supply roller 5 is subjected to a downwardly directing force F2. On the other hand, the leading end of the sheet P abutted against the receiving portion 115*a* of the inclined plate 115 is subjected to an upwardly directing force F1. As a result, by the action of these forces, the sheet P is rotated in a direction shown by the arrow C, thereby abutting the right side edge of the sheet against a side wall 20*a* of the base 20. Accordingly, since the sheet is separated from the sheet stack while being always abutted against the side wall 20*a* of the base 20, it is possible to feed the sheet without the skew-feed.

As mentioned above, in this example, it is possible to provide an automatic sheet supplying apparatus wherein a sheet supply roller 5 and a separating claw 17 are arranged only at one side, thus reducing the number of parts and making the apparatus small-sized and inexpensive.

In the case where a plurality of roller portions 5 are provided on the sheet supply roller 5, by increasing the feeding force of the roller portion 5*c* near the separating claw 17, it is possible to feed the sheet without skew-feed.

In order to increase the feeding force of the roller portion 5*c* near the separating claw 17, a friction force of the roller portion 5*c* near the separating claw 17 may be greater than those of the other roller portions 5*c*. For example, when rubber members are used as surfaces of the roller portions 5*c*, the friction force of the roller portion 5*c* near the separating claw 17 can easily be increased by changing the material of rubber of this roller portion or by performing the surface treatment (knurling or indentations) regarding this roller portion. Alternatively, by changing a position of the spring (not shown) for urging sheet stack P against the sheet supply roller 5 or by changing spring forces of such springs (when a plurality of such springs are used) to increase the spring force of the spring near the separating claw 17, it is also possible to increase the sheet feeding force of the roller portion 5*c* near the separating claw 17.

Figure 42:
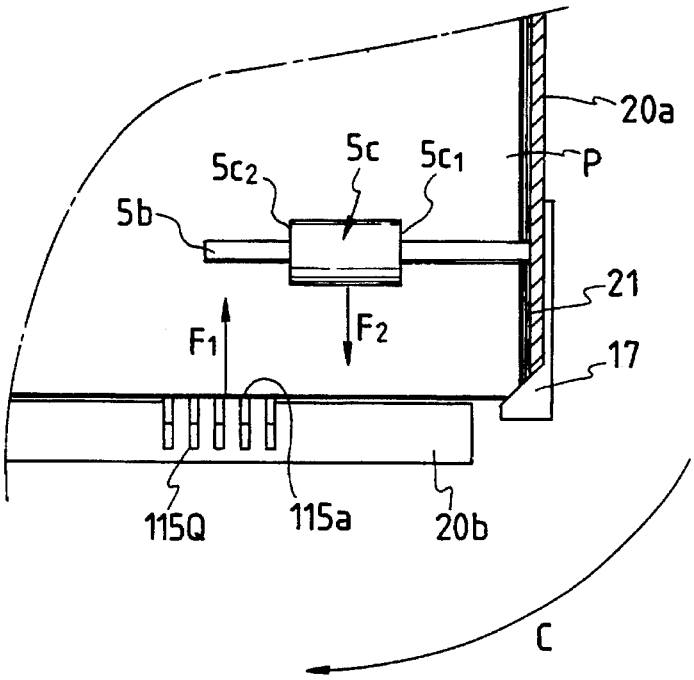
FIG. 42 is a partial front view of a sheet supplying apparatus according to a further embodiment.

Next, in an example shown in FIG. 42, a receiving portion 115 against which the leading end of the sheet P is abutted is constituted by ribs 115Q in place of the inclined plate 115. With this arrangement, since the contact area between the sheet and the receiving portion is reduced, it is possible to reduce the feeding resistance.

Figure 43:
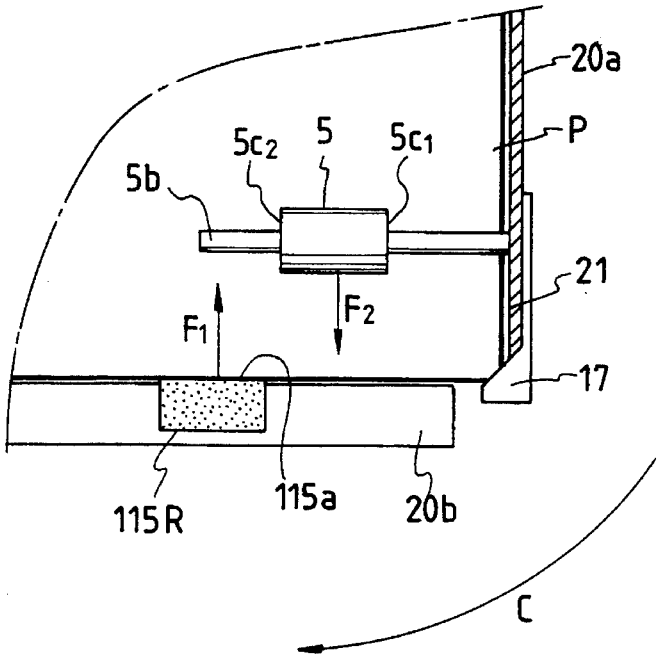
FIG. 43 is a partial front view of a sheet supplying apparatus according to a still further embodiment.

In an example shown in FIG. 43, a resistive member 115R is adhered to the receiving portion 115*a* against which the sheet P is abutted. In this case, the resistive member R may be formed from material having a coefficient of friction greater than that of the lower guide portion 20*b*. For example, synthetic leather can be used. With this arrangement, the same advantage as the above example can be achieved.

Figure 44:
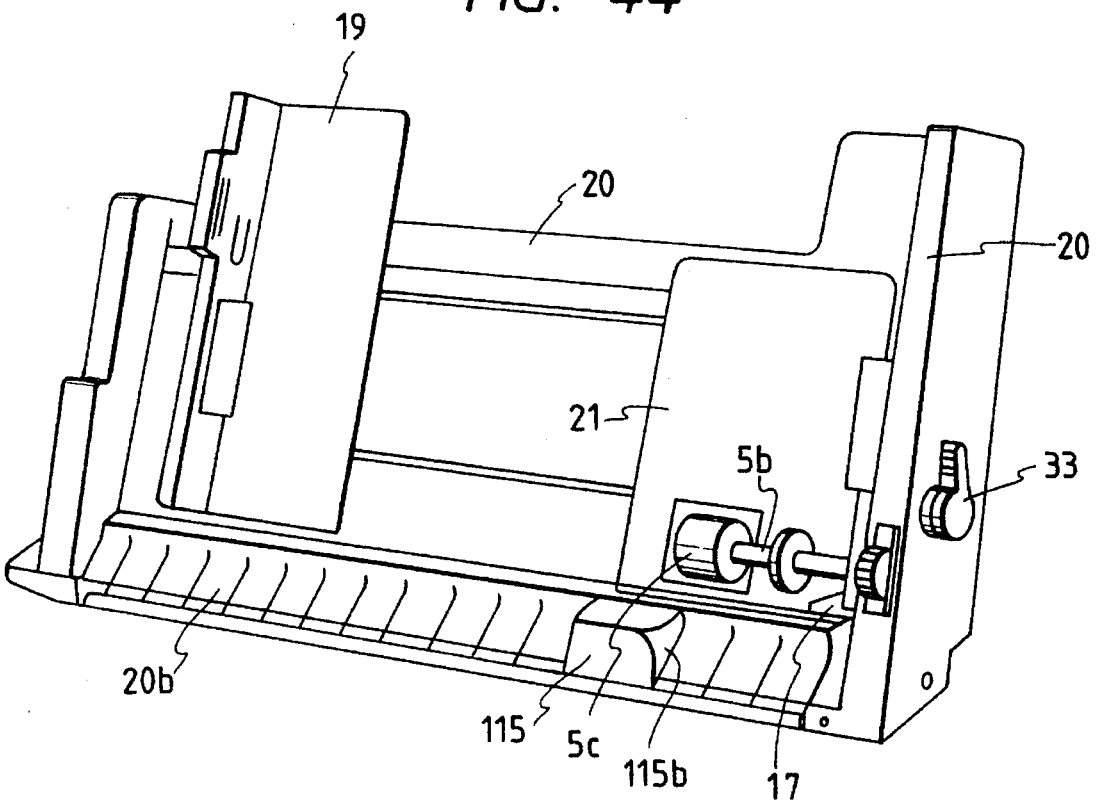
FIG. 44 is a perspective view of a sheet supplying apparatus according to a further embodiment.
Figure 45:
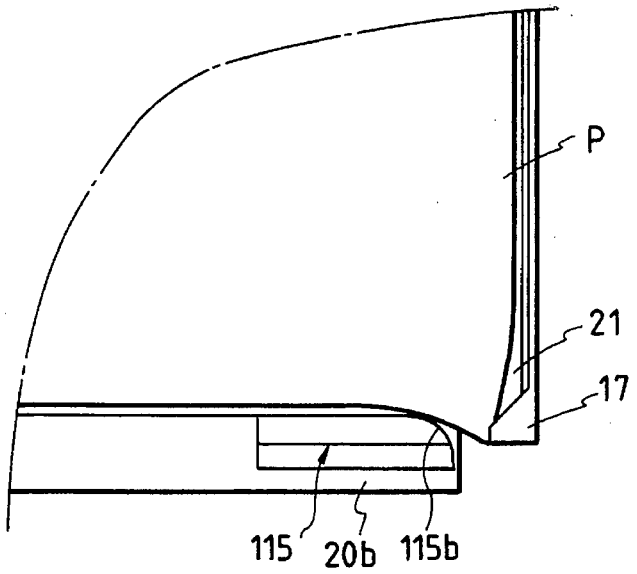
FIG. 45 is a partial front view of a sheet supplying apparatus according to a further embodiment.

In an example shown in FIGS. 44 to 48, an R-shaped curved surface portion 115*b* is formed on an end of the inclined plate 115 near the separating claw 17, as shown in FIGS. 44 and 45. With this arrangement, when the leading end of the sheet near the separating claw 17 passes over the inclined plate 115, as shown in FIG. 45, a loop can be formed in the leading end of the sheet near the separating claw 17 and a great space for escaping the sheet P can be established, thereby easily detaching the sheet from the separating claw 17. As a result, both front corners of the sheets can easily be fed between the upper guide and the lower guide portion 20*b*, thus preventing the skew-feed of the sheet.

Figure 46:
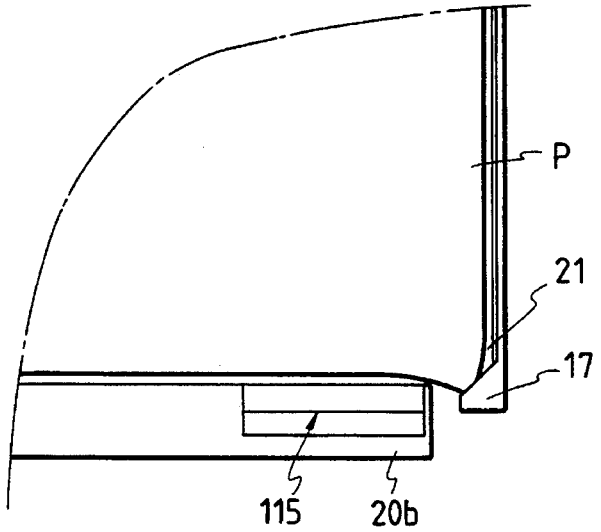
FIG. 46 is a partial front view of a sheet supplying apparatus according to a still further embodiment.

As shown in FIG. 46, if there is no R-shaped curved surface at the end of the inclined plate 115, the leading end of the sheet near the separating claw 17 will be hard to separate from the separating claw during the sheet separating operation since an amount of the loop cannot be controlled in accordance with the material of the sheet and/or environmental condition.

Figure 47:
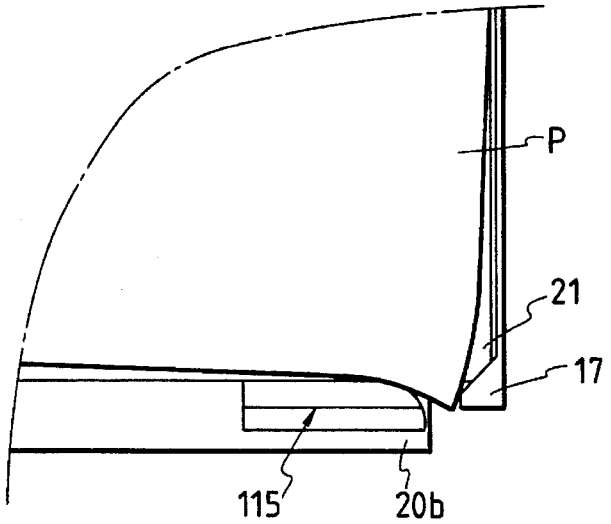
FIG. 47 is a partial front view showing an operation of the sheet supplying apparatus of FIG. 45.
Figure 48:
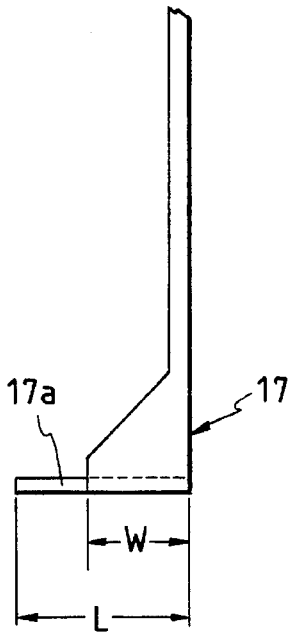
FIG. 48 is a front view showing a configuration of an improved separating claw.

Further, in the above example, although the leading end of the sheet near the separating claw 17 is apt to separate from the separating claw, as a result, it is feared that a looped leading end of the sheet near the separating claw 17 cannot be abutted against the abutment portion 17*a* of the separating claw 17 due to the minute deviation of the set sheet stack P (toward a direction away from the separating claw 17), thus making the sheet separation by the separating claw 17 impossible (FIG. 47). To avoid this, even when there is the deviation of the set sheet stack P more or less, in order to enable the sheet separation by the separating claw, a length L of the abutment portion 17*a* becomes greater than a width W of the separating claw 17 (FIG. 48). With this arrangement, it is possible to prevent the leading end of the sheet P near the separating claw 17 from being fed with the claw separation. Incidentally, if the claw separation is not effected correctly, the sheet P will be skew-fed as shown in FIG. 47.

Figure 49:
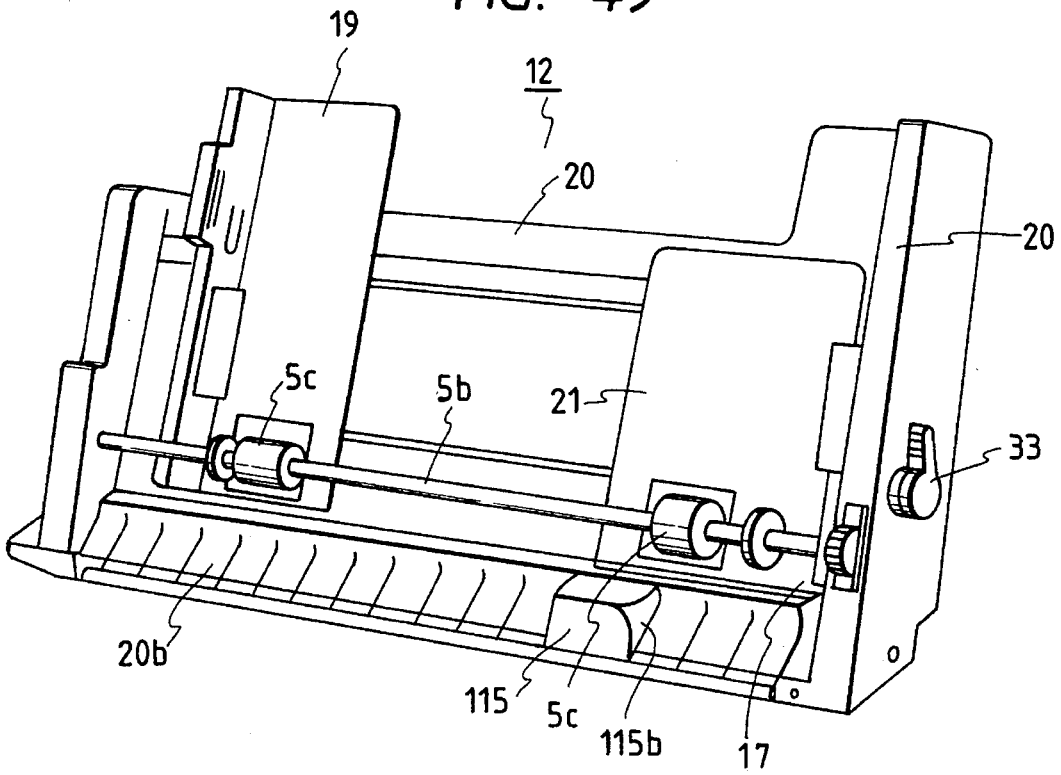
FIG. 49 is a perspective view of a sheet supplying apparatus according to a further embodiment.

In an example shown in FIG. 49, a plurality of (two in the illustrated example) roller portions 5*c* is provided on a sheet supply roller 5. Also with this arrangement, the same advantage as the above example can be achieved.

Figure 50:
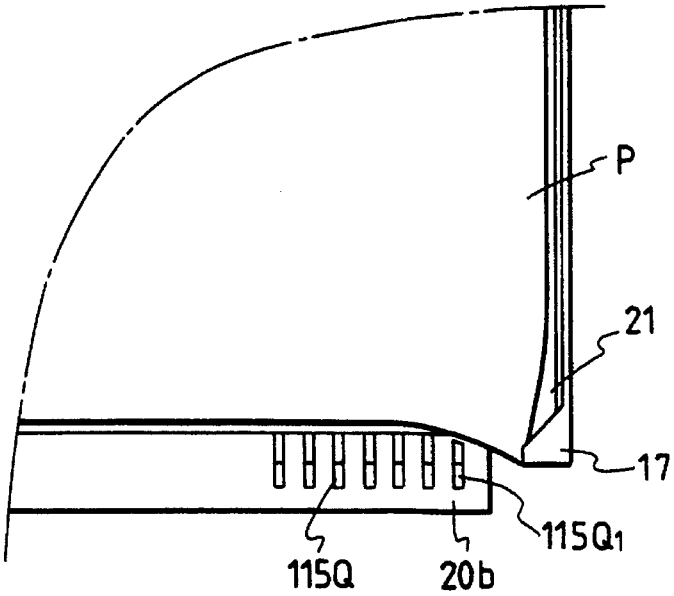
FIG. 50 is a partial front view of a sheet supplying apparatus according to a further embodiment.

Next, in an example shown in FIG. 50, an inclined plate 115 is constituted by inclined ribs (rib members) 115Q, and the inclined rib near the separating claw 17 (for example, the inclined rib 115$Q_1$) is lower than the other inclined ribs. With this arrangement, the same advantage as the R-shaped curved surface 115*b* of the inclined plate 115 can be achieved.

Figure 51:
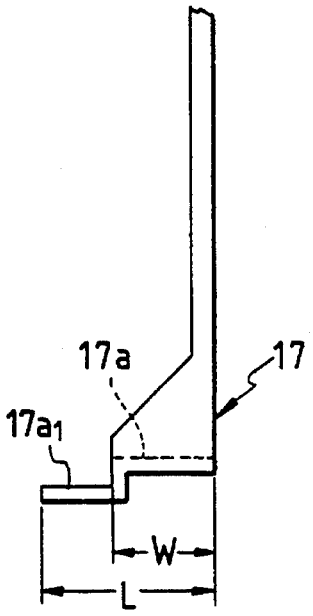
FIG. 51 is a front view showing a configuration of an improved separating claw.
Figure 52:
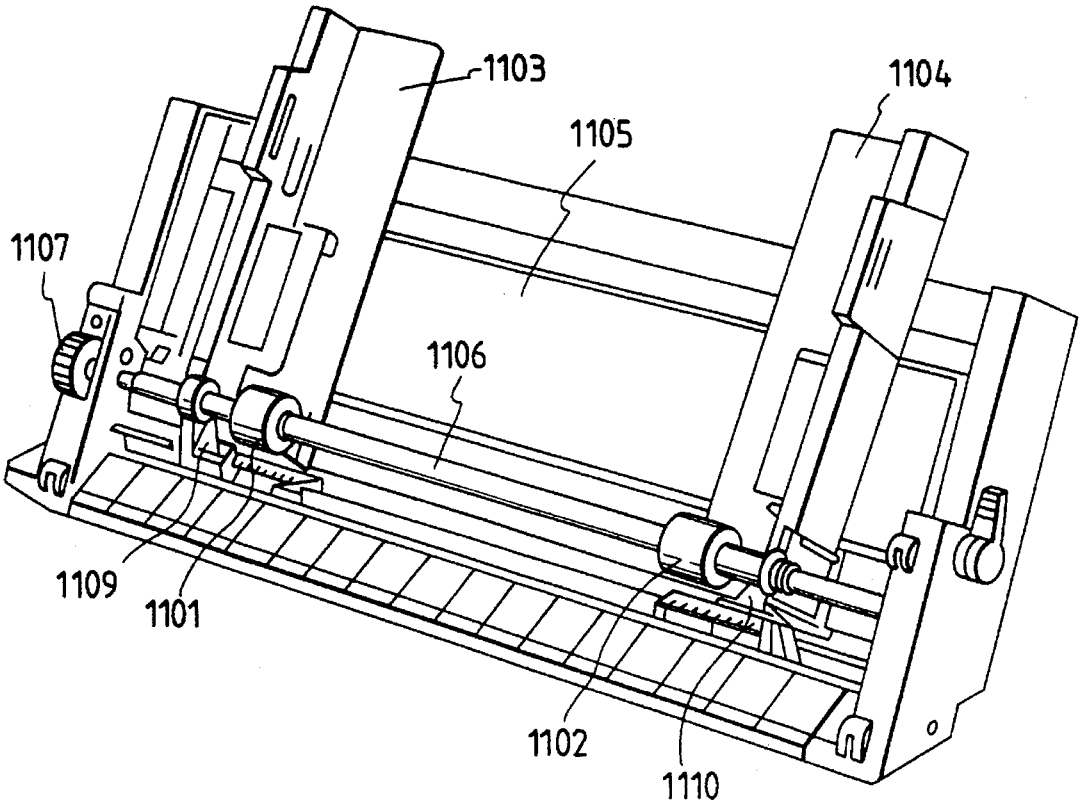
FIG. 52 PRIOR ART
FIG. 52 is a perspective view of a conventional sheet supplying apparatus.

Lastly, in an example shown in FIG. 51, a length L of the abutment portion 17*a* of the separating claw 17 becomes greater than a width W of the separating claw 17 as in the case of FIG. 48. Further, an extension 17$a_1$ of the abutment portion is disposed downstreamly (in the sheet feeding direction) so that the whole abutment portion 17*a* has a stepped configuration.

With this arrangement of the abutment portion 17*a*, since the leading end portion of the sheet is abutted against the abutment portion with a smaller area, it is possible to reduce the resistance during the sheet separation, thus permitting the smooth sheet separation.

What is claimed is:

1. A sheet supplying apparatus, comprising:

sheet supporting means for supporting sheets;

sheet supply means for feeding out the sheets supported by said sheet supporting means;

a separation claw, arranged at one front corner of the sheets supported by said sheet supporting means, for separating the sheets fed by said sheet supply means one by one, said separation claw having an abutment portion against which a leading end of a sheet fed by said sheet supply means is abutted; and regulating means for regulating leading ends of the sheets fed out by said sheet supply means;

wherein said sheet supply means is positioned between said separation claw and said regulating means in a widthwise direction of the sheet supported by said sheet supporting means, and said abutment portion is disposed downstream of said regulating means in a sheet feeding direction.

2. A sheet supplying apparatus according to claim 1, wherein said separation claw, said sheet supply means and said regulating means are arranged offset toward one side, from a center of said sheet supporting means.

3. A sheet supplying apparatus according to claim 2, further comprising guide means for guiding the sheet separated by said separation claw, said guide means guiding the sheet whose edge is abutted against said guide means when separated by said separation claw so that a longitudinal direction of the sheet becomes substantially parallel to the sheet feeding direction.

4. A sheet supplying apparatus according to claim 1, wherein said sheet supply means comprises a sheet supply roller, a first end face of said sheet supply roller that is adjacent said separation claw is positioned between a first end face of said regulating means, which is adjacent said separation claw, and said separation claw, and a second end face of said sheet supply roller that is remote from said separation claw is positioned between a second end face of said regulating means, which is positioned remote from said separation claw, and said separation claw.

5. A sheet supplying apparatus according to claim 1, wherein said separation claw comprises a hold-down portion for holding down an upper surface of the sheet.

6. A sheet supplying apparatus according to claim 5, wherein a connecting surface is arranged between said abutment portion and said hold-down portion of said separating claw.

7. A sheet supplying apparatus according to claim 5, wherein said abutment portion of said separation claw extends more than said hold-down portion in a direction perpendicular to the sheet feeding direction.

8. A sheet supplying apparatus according to claim 1, wherein said sheet supporting means supports the sheets at a predetermined angle with respect to a horizontal plane, and said sheet supply means feeds out an uppermost sheet of the sheets supported by said sheet supporting means.

9. A sheet supplying apparatus according to claim 1, further comprising a guide surface for guiding the sheet toward a downstream side of said sheet supporting means, wherein said regulating means comprises a protruded member protruding from said guide surface.

10. A sheet supplying apparatus according to claim 9, wherein a curved surface is formed on said regulating means near said separation claw.

11. A sheet supplying apparatus according to claim 1, further comprising a guide surface for guiding the sheet toward a downstream side of said sheet supporting means, wherein said regulating means comprises a plurality of ribs protruding from said guide surface.

12. A sheet supplying apparatus according to claim 11, wherein a curved surface is formed on said regulating means near said separation claw.

13. A sheet supplying apparatus, comprising:

sheet supporting means for supporting sheets;

a plurality of rotary sheet supply members for feeding out the sheets supported by said sheet supporting means;

a separation claw, arranged at one front corner of the sheets supported by said sheet supporting means, for separating the sheets fed by said rotary sheet supply members one by one, said separation claw having an abutment portion against which a leading end of a sheet fed by said rotary sheet supply members is abutted; and regulating means for regulating leading ends of the sheets fed out by said sheet supply members, wherein a rotary sheet supply member located closest to said separation claw is positioned between said separation claw and said regulating means in a widthwise direction of the sheet supported by said supporting means, and said abutment portion is disposed downstream of said regulating means in a sheet feeding direction.

14. A sheet supplying apparatus according to claim 13, wherein said plurality of sheet supply members comprises a plurality of sheet supply rollers, and a first end face of said sheet supply roller that is closest to said separation claw is positioned between a first end face of said regulating means, which is adjacent said separation claw, and said separation claw, and a second end face of said sheet supply roller that is remote from said separation claw is positioned between a second end face of said regulating means, which is positioned remote from said separation claw, and said separation claw.

15. A sheet supplying apparatus according to claim 13, further comprising guide means for guiding the sheet separated by said separation claw, said guide means guiding the sheet whose edge is abutted against said guide means when separated by said separation claw so that a longitudinal direction of the sheet becomes substantially parallel to the sheet feeding direction.

16. A sheet supplying apparatus according to claim 13, wherein said separation claw comprises a hold-down portion for holding down an upper surface of the sheet.

17. A sheet supplying apparatus according to claim 13, wherein said sheet supporting means supports the sheets at a predetermined angle with respect to a horizontal plane, and said sheet supply members feed out an uppermost sheet of the sheets supported by said sheet supporting means.

18. A sheet supplying apparatus, comprising:

sheet supporting means for supporting sheets;

a plurality of rotary sheet supply members for feeding out the sheets supported by said sheet supporting means; and a separation claw, arranged at one front corner of the sheets supported by said sheet supporting means, for separating the sheets fed by said rotary sheet supply members one by one, said separation claw having an abutment portion against which a leading end of the sheets supported by said sheet supporting means is abutted;

wherein said rotary sheet supply member disposed closest to said separation claw starts a feeding operation before other rotary sheet supply members start the feeding operation so that a longitudinal direction of the sheet separated by said separation claw becomes substantially parallel to a sheet feeding direction when the leading end of the sheet is abutted against said abutment portion.

19. A sheet supplying apparatus according to claim 18, wherein said rotary sheet supply members comprise sheet supply rollers, each roller having a cut-out portion, and said sheet supply roller closest said separation claw is abutted against the sheet prior to the other sheet supply rollers by differentiating phases of said sheet supply rollers.

20. A sheet supplying apparatus according to claim 18, wherein said rotary sheet supply members comprise sheet supply rollers, each roller having a cut-out portion, and, a partial diameter of a portion of said sheet supply roller closest to said separation claw is formed relatively large so as to first abut against the sheet when a sheet supplying operation by said closest sheet supply roller is started.

21. A sheet supplying apparatus according to claim 18, wherein said sheet supporting means comprises a pivotable pressure plate and biasing means for biasing said pressure plate toward said sheet supply members, and, said rotary sheet supply member closest to said separation claw first abuts against the sheet by changing a timing for shifting said pressure plate from a waiting position to a sheet supply position between left and right sides of said pressure plate by differentiating phases of cams arranged at the left and right sides of said pressure plate to separate said pressure plate from said sheet supply members in a waiting condition.

22. A sheet supplying apparatus comprising:

sheet supporting means for supporting sheets;

sheet supply means for feeding out the sheets supported by said sheet supporting means;

a separation claw, arranged at one front corner of the sheets supported by said sheet supporting means, for separating the sheets fed by said sheet supply means one by one, said separation claw having an abutment portion against which a leading end of the sheet fed by said sheet supply means is abutted; and regulating means for regulating leading ends of the sheets, wherein said sheet supply means is positioned between said separation claw and said regulating means in a widthwise direction of the sheets supported by said sheet supporting means, and the abutment portion is so disposed such that the leading end of the sheet is abutted against the abutment portion after said regulating means regulates the leading end of the sheet.

23. A sheet supplying apparatus according to claim 22, wherein said regulating means comprises a receiving portion which supports the sheets on said sheet supporting means.

24. A sheet supplying apparatus according to claim 23, wherein said abutment portion is disposed downstream of said receiving portion in a sheet feeding direction.

25. An image forming apparatus comprising:

sheet supporting means for supporting sheets;

sheet supply means for feeding out the sheets supported by said sheet supporting means;

a separation claw, arranged at one front corner of the sheets supported by said sheet supporting means, for separating the sheets fed by said sheet supply means one by one, said separation claw having an abutment portion against which a leading end of a sheet fed by said sheet supply means is abutted;

regulating means for regulating leading ends of the sheets fed out by said sheet supply means; and image forming means for forming an image on the sheet fed by said sheet supply means, wherein said sheet supply means is positioned between said separation claw and said regulating means in a widthwise direction of the sheet supported by said sheet supporting means, and said abutment portion is disposed downstream of said regulating means in a sheet feeding direction.

26. An image forming apparatus according to claim 25, wherein said image forming means comprises an electrothermal converter and forms the image by discharging ink from a discharge opening due to the growth and contraction of a bubble generated by heating said electrothermal converter to a temperature greater than a film boiling temperature by energizing said electrothermal converter.

27. An image forming apparatus comprising:

sheet supporting means for supporting sheets;

a plurality of rotary sheet supply members for feeding out the sheets supported by said sheet supporting means;

a separation claw, arranged at one front corner of the sheets supported by said sheet supporting means, for separating the sheets fed by said rotary sheet supply members one by one, said separation claw having an abutment portion against which a leading end of a sheet fed by said rotary sheet supply members is abutted;

regulating means for regulating leading ends of the sheets fed out by said sheet supply members; and image forming means for forming an image on the sheet fed by said rotary sheet supply members, wherein a rotary sheet supply member located closest to said separation claw is positioned between said separation claw and said regulating means in a widthwise direction of the sheet supported by said supporting means, and said abutment portion is disposed downstream of said regulating means in a sheet feeding direction.

28. An image forming apparatus according to claim 27, wherein said image forming means comprises an electrothermal converter and forms the image by discharging ink from a discharge opening due to the growth and contraction of a bubble generated by heating said electrothermal converter to a temperature greater than a film boiling temperature by energizing said electrothermal converter.

29. An image forming apparatus comprising:

sheet supporting means for supporting sheets;

a plurality of rotary sheet supply members for feeding out the sheets supported by said sheet supporting means;

a separation claw, arranged at one front corner of the sheets supported by said sheet supporting means, for separating the sheets fed by said rotary sheet supply members one by one, said separation claw having an abutment portion against which a leading end of the sheets supported by said sheet supporting means is abutted; and image forming means for forming an image on the sheet fed by said sheet supply members, wherein said rotary sheet supply member disposed closest to said separation claw starts a feeding operation before other rotary sheet supply members start the feeding operation so that a longitudinal direction of the sheet separated by said separation claw becomes substantially parallel to a sheet feeding direction when the leading end of the sheet is abutted against said abutment portion.

30. An image forming apparatus according to claim 29, wherein said image forming means comprises an electrothermal converter and forms the image by discharging ink from a discharge opening due to the growth and contraction of a bubble generated by heating said electrothermal converter to a temperature greater than a film boiling temperature by energizing said electrothermal converter.

* * * * *

UNITED STATES PATENT AND TRADEMARK OFFICE

CERTIFICATE OF CORRECTION

PATENT NO. : 5,480,247 Page 1 of 3

DATED : January 2, 1996

INVENTOR(S) : Satoshi SAIKAWA, et al.

It is certified that error appears in the above-indentified patent and that said Letters Patent is hereby corrected as shown below:

COLUMN 4:

Line 67, "rollers 35," should read --rollers 36,--.

COLUMN 7:

Line 31, "cain 76" should read --cam 76--.

COLUMN 8:

Line 8, "Lever 33." should read --lever 33.--;
Line 14, "cain" should read --cam--;
Line 62, "in" should be deleted.

COLUMN 9:

Line 17, "10" should be deleted;
Line 50, "speed" should read --spaced--.

COLUMN 10:

Line 14, "If" should begin a new paragraph;
Line 24, "Then," should begin a new paragraph;
Line 32, "First" should begin a new paragraph;

UNITED STATES PATENT AND TRADEMARK OFFICE

CERTIFICATE OF CORRECTION

PATENT NO. : 5,480,247 Page 2 of 3

DATED : January 2, 1996

INVENTOR(S) : Satoshi SAIKAWA, et al.

It is certified that error appears in the above-indentified patent and that said Letters Patent is hereby corrected as shown below:

Line 34, "Firstly," should begin a new paragraph;
Line 45, "Then," should begin a new paragraph;
Line 57, "front" should read --from--;
Line 65, "Next," should begin a new paragraph.

COLUMN 12:

Line 60, "claw 17" should read --claws 17--.

COLUMN 15:

Line 31, "an" should read --a--.

COLUMN 17:

Line 1, "portions 5" should read --portions 5c--.

UNITED STATES PATENT AND TRADEMARK OFFICE

CERTIFICATE OF CORRECTION

PATENT NO. : 5,480,247 Page 3 of 3

DATED : January 2, 1996

INVENTOR(S) : Satoshi SAIKAWA, et al.

It is certified that error appears in the above-indentified patent and that said Letters Patent is hereby corrected as shown below:

COLUMN 18:

Line 20, "downstreamly" should read --downstream--.

COLUMN 20:

Line 36, "closest" should read --closest to--.

Signed and Sealed this

Thirtieth Day of April, 1996

*Attest:*

*Attesting Officer*

BRUCE LEHMAN

*Commissioner of Patents and Trademarks*